US007135262B2

(12) United States Patent
Itami

(10) Patent No.: US 7,135,262 B2
(45) Date of Patent: Nov. 14, 2006

(54) IMAGE FORMING METHOD

(75) Inventor: Akihiko Itami, Hachioji (JP)

(73) Assignee: Konica Corporation, Tokyo (JP)

( * ) Notice: Subject to any disclaimer, the term of this patent is extended or adjusted under 35 U.S.C. 154(b) by 7 days.

(21) Appl. No.: 10/663,137

(22) Filed: Sep. 15, 2003

(65) Prior Publication Data

US 2004/0067428 A1 Apr. 8, 2004

(30) Foreign Application Priority Data

Sep. 27, 2002 (JP) ..... 2002-283065

(51) Int. Cl.
*G03G 15/08* (2006.01)

(52) U.S. Cl. ..... 430/100; 430/110.4

(58) Field of Classification Search ..... 430/100, 430/110.4

See application file for complete search history.

(56) References Cited

U.S. PATENT DOCUMENTS 5,821,021 A * 10/1998 Kawahara ..... 430/78
2001/0051307 A1* 12/2001 Ikuno et al. ..... 430/58.05
2003/0054269 A1* 3/2003 Yamazaki et al. ..... 430/126

FOREIGN PATENT DOCUMENTS

JP 01048077 A * 2/1989
JP 01065561 A * 3/1989
JP 01093772 A * 4/1989
JP 05-119503 5/1993
JP 06-118681 4/1994
JP 2002-196522 7/2002

OTHER PUBLICATIONS

Diamond, Arthur S & David Weiss (eds.) Handbook of Imaging Materials. New York: Marcel-Dekker, Inc. (Nov. 2001) pp. 369-382.*

Diamond, Arthur S & David Weiss (eds.) Handbook of Imaging Materials. New York: Marcel-Dekker, Inc. (Nov. 2001) pp. 370-377.*

* cited by examiner

*Primary Examiner*—Christopher Rodee
(74) *Attorney, Agent, or Firm*—Squire, Sanders & Dempsey L.L.P.

(57) ABSTRACT

An electrostatic toner image forming method is disclosed. In the method, the photoreceptor comprises a charge generation layer containing an N-type charge generation material and a charge transportation layer containing a charge transportation material and has a thickness of from 5 to 15 μm; and the toner contains colored particles which have a ratio, $Dv_{50}/Dp_{50}$, from 1.0 to 1.15 and a ratio, $Dv_{75}/Dp_{75}$, from 1.0 to 1.20 and the content of particles having a diameter of $0.7\times Dp_{50}$ is not more than 10 in number, and the reversal development is performed under a condition satisfying the following expression;

$50 \leq |E| \leq 100$ Expression 1

E: Electrical field intensity applied to the organic photoreceptor during development.

8 Claims, 4 Drawing Sheets

IMAGE FORMING METHOD

FIELD OF THE INVENTION

The present invention relates to an image forming method and an image forming apparatus to be used in the field of copying machines or printers employing electrophotography.

BACKGROUND OF THE INVENTION

Recently, organic photoreceptors have been widely used as electrophotographic photoreceptors. Organic photoreceptors have advantages compared to other photoreceptors such as that a material suited for various exposure light sources emitting various wavelengths light from visible rays to infrared rays can be easily developed, a material with pollution potential to the environment can be selected and the production cost thereof is low. However it also has drawbacks such as that the mechanical strength and chemical resistively are low and tending of degradation of the static property, and on the surface is easily damaged.

Electrical and mechanical stress is applied directly to the organic photoreceptor, hereinafter simply referred to as photoreceptor, by a charging means, a developing means and a cleaning means. Accordingly, resisting ability against the stress is required of the photoreceptor.

Furthermore, resistivity to counter abrasion and often damage as well as degradation caused by reactive oxygen such as ozone and nitrogen oxide generated during corona discharge is required of the photoreceptor.

A constitution of the photoreceptor is frequently employed to overcome such mechanical and chemical resistivity problems in which the organic photoreceptor is constituted by series of layers of a charge generation layer and a charge transportation layer, in which the charge transportation layer as the surface layer is made of a uniform layer having high strength and high resistivity against permeation of the reactive gas, and the thickness of the charge transportation layer is not less than 20 μm.

Another investigated approach to overcome the problems is a method which provides a protective layer having high strength on the surface of the photoreceptor, as disclosed in JP-A 6-118681. However, such methods to increase the thickness of the charge transportation layer or to provide a stronger protective layer causes problems of image sharpness since the carriers generated in the charge generation are diffused to the sides before arriving at the surface. In the field of digital copying machines, formation a high resolution image is required to meat the demand of high image quality. However, a suitable static latent image can not be obtained by such a layer structure, or in the presence the protective layers causing diffusion of the carriers.

It is necessary for high fidelity reproduction to sufficiently maintain the potential contrast between the exposed and the unexposed areas of the photoreceptor. It is also important to inhibit the diffusion of generated carriers before the arrival at the surface charge for reproducing the high fidelity image. When the ratio D/μ of the diffusion constant D to the drift mobility μ in the charge transportation layer is large, the effect of the diffusion on the degradation of the high density static latent image must be taken into argument. Consequently the degradation of the static latent image is increased when the thickness of the charge transportation layer is increased, as disclosed in "Nihon Gazou Gakkai Shi (Journal of Image Society of Japan)" Vol. 38. No. 4, p. 296.

A photoreceptor in which the thickness of the charge transportation layer is reduced to inhibit diffusion of the static latent image has been proposed, as disclosed in JP-A 5-119503. However, in practice an unclear image with lowered image density tends to form when an image is formed by employing an image forming apparatus in which such a proposed organic photoreceptor is used. Such a phenomenon is due to by lowering of the static potential accompanied with reduction of the static capacity of the photoreceptor. As a result, the developability and the image density are lowered. Particularly, problems occur in that the developability is lowered and the image density formed by the reversal development is insufficient, and a text image and photographic image having high sharpness can be obtained with difficulty only when a developer employing a small particle toner is used.

For recovering such lowering of the developability it is effective to increase the amount of charge per unit area of a thin layer organic photoreceptor so as to increase the electrical field intensity per unit layer thickness. However, both image defects of black spotting and white spotting tend to occur during reversal development when the electrical field intensity per unit thickness of the photoreceptor is raised. Namely, the image defect of black spotting tends to form since charge injection unrelated to the image is increased, in relation to the increase of the electrical field intensity in the photoreceptor. As methods to prevent such black spotting defects, countermeasures providing an interlayer and an electrical isolation layer on the surface of the conductive substrate by anodization to prevent the injection of free carriers. For example, a photoreceptor has been proposed which has a thin photoreceptor layer and an interlayer containing titanium oxide particles as disclosed in JP-A 2002-196522. However, black spotting cannot be sufficiently prevented during reversal development by the foregoing method which causes the increased electrical field intensity.

On the other hand, image sharpness tends to be degraded since an image defect, so called white spotting is formed when the electrical field intensity-is raised. It is assumed that the surface charge at the exposed areas does not disappear which is caused by filming of small toner particles. When the surface charge of the photoreceptor is increased, the ability to clean the toner is lowered due to a rise of Coulomb's force between the photoreceptor and the toner particles so that the white spotting tends to occur. The defect of white spotting easily occurs due to the increase in the surface area when extremely small particle toner is used.

SUMMARY OF THE INVENTION

The objective of the invention is to solve the foregoing problems, namely, to provide an image forming method and an image forming apparatus using an organic photoreceptor, by which a sharp static latent image can be precisely formed and the latent image can be visualized with high fidelity, and image defects such as black spotting whereby white spotting are prevented and high quality images of high sharpness and suitable gradation can be obtained.

As a result of investigations by the inventors of the foregoing problems, it was found to be necessary to inhibit the diffusion of the carriers and to prevent both image defects of black spotting occurrence and the white spotting by constituting the organic photoreceptor to function as a separated structure composed of a charge generating layer and a charge transportation layer, and also by reducing the thickness of the charge transportation layer constituting the surface layer, resulting in improving the image sharpness by the use of a thin layer organic photoreceptor and preventing image defects such as black spotting and white spotting which tend to occur by the reversal development in a high intensity electrical field (reversal development under a condition of an increased charge amount per unit area of the photoreceptor). It was found to be important to attain the purpose to employ a substance capable of blocking the injection of free carriers as the charge generation substance in the charge generation layer to prevent the injection of the free carriers from the electroconductive substrate, which easily occurs when thickness of the charge transportation layer is reduced, and to use a developer in which toner filming causing the white spotting is formed with difficulty.

The present invention and its embodiments are described.

A method of forming a toner image, comprising:

electrically charging a photoreceptor containing an organic photosensitive material;

imagewise exposing the photoreceptor so that a latent image is formed on the photoreceptor;

developing the latent image with toner so that a toner image is formed on the photoreceptor by a reversal development;

wherein the photoreceptor comprises a charge generation layer containing an N-type charge generation material and a charge transportation layer containing a charge transportation material and has a thickness of from 5 to 15 μm; and the toner contains colored particles comprising a resin and a colorant, the colored particles have a ratio, $Dv_{50}/Dp_{50}$, of the 50% volume particle diameter $Dv_{50}$ to the 50% number particle diameter $Dp_{50}$ of from 1.0 to 1.15 and a ratio, $Dv_{75}/Dp_{75}$, of the accumulate of 75% volume average particle diameter from the larger particle side to the accumulate of 75% number average particle diameter from the larger particle side of from 1.0 to 1.20, and the content of particles having a diameter of $0.7\times Dp_{50}$ is not more than 10 in number, and the reversal development is performed under a condition satisfying the following expression.

$$50 \leqq |E| \leqq 100 \qquad \text{Expression 1}$$

E: Electrical field intensity applied to the organic photoreceptor during development.

The image forming method in which the charge generation layer further contains a P-type pigment in an amount of not more than 10% by weight of the N-type charge generating material.

The image forming method in which the N-type charge generation material is a perylene compound pigment.

The image forming method in which the perylene compound is a 3,4,9,10-tetracarboxylic acid imide derivative represented by the Formula 1, 2, 3a or 3b, or a mixture thereof.

Formula 1

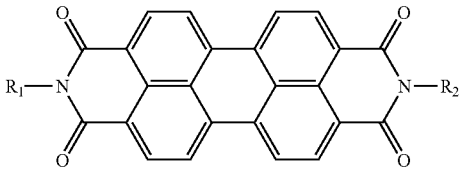

-continued

Formula 2

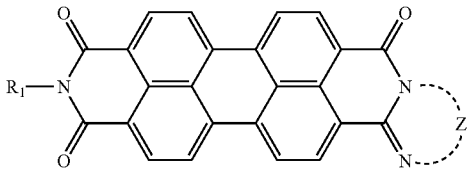

Formula 3a

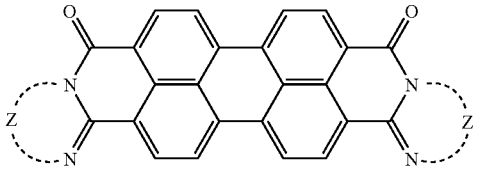

Formula 3b

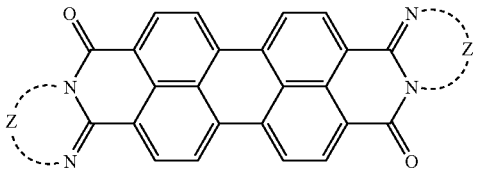

in the above formulas, $R_1$ and $R_2$ are each a hydrogen atom, or an alkyl group, a cycloalkyl group, an aryl group, an alkoxy group, an alkylamino group, a dialkylamino group, a benzyl group, a phenethyl group or a heterocyclic group, and the above organic groups may be substituted or unsubstituted. When the compound is a polymer, $R_1$ and $R_2$ each may be a 1,4-phenylene group. Z is a group of atoms necessary to form a heterocyclic group.

The image forming method in which the static latent image is formed by exposure to a light beam having an exposing spot area of not more than $2\times10^{-9}$ $m^2$.

DETAILED DESCRIPTION OF THE INVENTION

Figure 1:
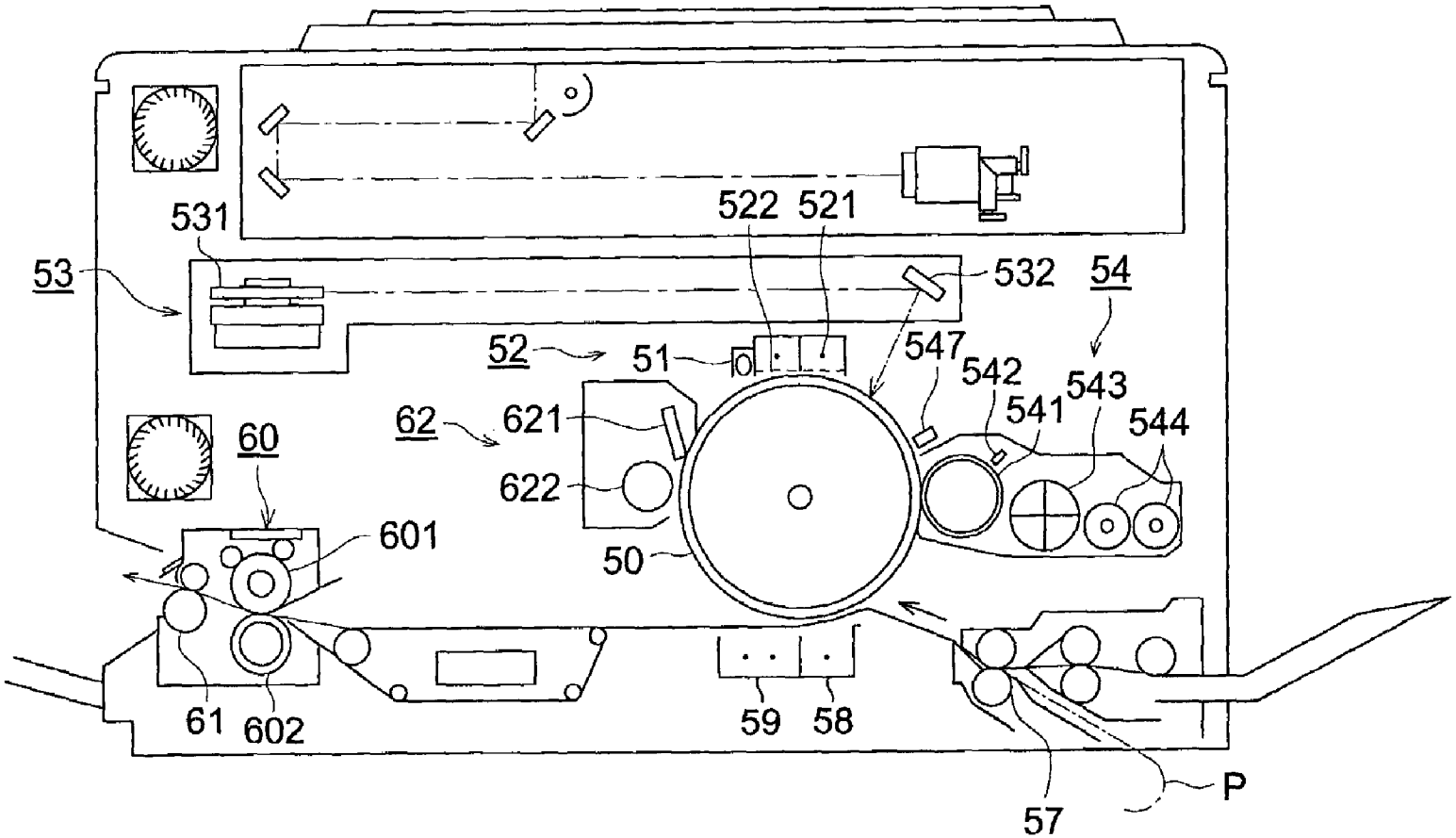
FIG. 1 shows a cross section of an image forming apparatus as an example of the image forming method of the invention.

In the image forming method of the invention, the organic photoreceptor is constituted of an electroconductive substrate and a charge generation layer, and one or more charge transportation layer provided in such order on the substrate. In such an organic photoreceptor, the charge generation layer contains an N-type charge generation material, and the total thickness of which charge transportation layers is from 5 to 15 μm.

In the invention, an electrophotographic image, in which the occurrence of the black spotting and the white spotting is inhibited and the sharpness of both text images and halftone images is improved, can be obtained by developing the latent image by using the above components organic photoreceptor and a toner having the specified particle diameter distribution, even when the image is formed by reversal development under an intensified electrical field.

The organic photoreceptor employed in the invention is described below.

The organic photoreceptor employed in the invention is constituted of an electroconductive substrate, a charge generation layer and a charge transportation layer provided on the substrate in that order, and the charge generation layer contains N-type charge generation material.

The method for distinguishing the N-type and the P-type charge generation substances follows.

A 10 μm charge generation layer is formed on an electroconductive substrate from a suspension comprising a binder and 50% by weight of the charge generation material to be tested. The charge generation layer is negatively charged and the photo-decay of the charge is determined. On the other hand, the charge generation layer is positively charged and the photo-decay of the charge is similarly determined.

A charge generation material in which photo-decay of the negative charge is larger than that of the positive charge is an N-type charge generation material.

A charge generation material in which photo-decay of the positive charge is larger than that of the negative charge is a P-type charge generation material.

Examples of preferable N-type charge generation materials include perylene, 1-nitroperylene, 1,12-o-phenyleneperylene, and 1,3,7,9-tetraacetoxyperylene. Of these, a 3,4,9,10-tetracarboxylic acid imide derivative is preferred. Examples represented by Formulas 1–3 are particularly preferred.

The chemical structure of these compounds may be symmetrical or asymmetrical. Ones having the cis form and ones having the trans form are included. Such isomers may be used either in the form of a single substance separated after synthesis or in the form of a mixture formed by the synthesis thereof.

The perylene compounds represented by Formula 3a or 3b are suitably used and the perylene compounds represented by the following formulas are most preferred.

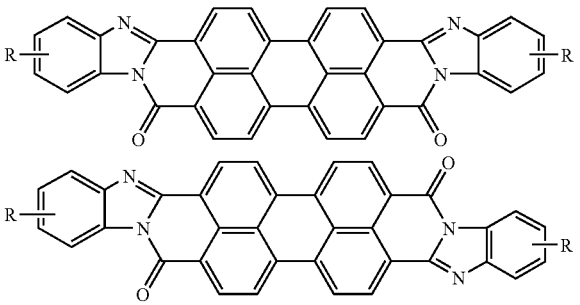

In the above formulas, R is a hydrogen atom, a halogen atom, an alkyl group having from 1–10 carbon atoms, an aryl group, an alkoxy group or a heterocyclic group. The above components perylene compounds each assume a crystal form, and ones having any crystal form are suitably used. For example one having a crystal form showing peaks of Bragg's angle 2θ at 6.3°, 12.4°, 25.3° and 27.1° and the maximum peak at 12.4° in the X-ray diffraction spectrum and one having an amorphous form showing almost no clear peak are also usable. When these compounds are used in the carrier generation layer, a dispersion of the perylene compound having a specific crystal form may be used, and the carrier generation layer may be formed by vapor deposition. The crystal form of the vapor deposited layer may be converted by a treatment by solvent.

Specific examples of suitable perylene compound in this invention are listed below.

Specific examples of the compound represented by Formula 1

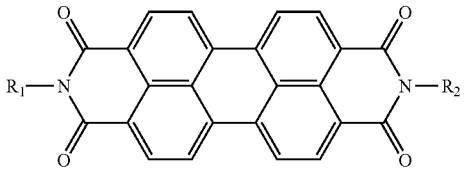

Examples of the group represented by $R_1$ or $R_2$ in the foregoing Formula 1 include the following; groups each represented by $R_1$ or $R_2$ may be the same or different.

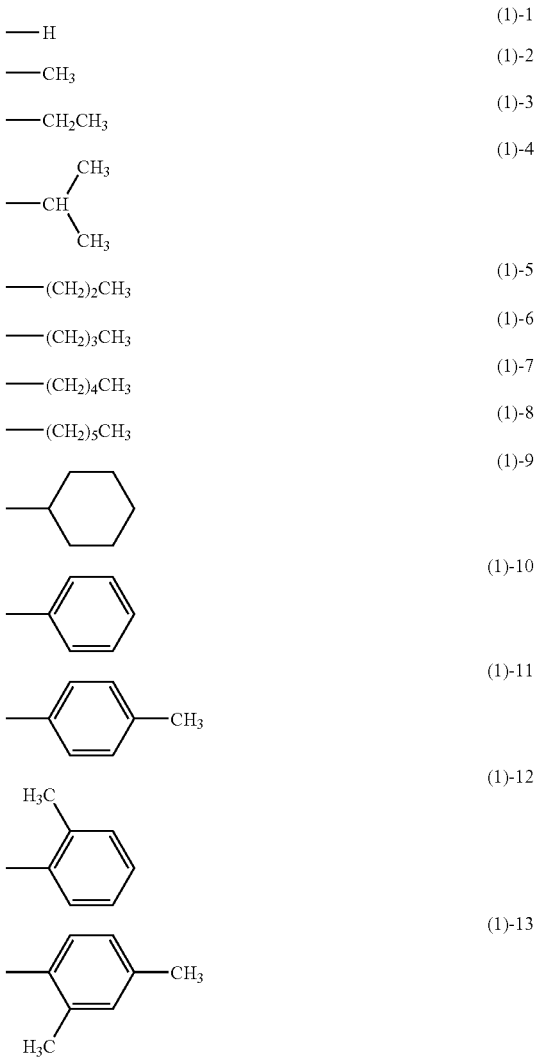

-continued
(1)-14
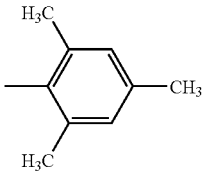
(1)-15
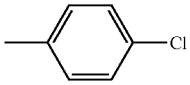
(1)-16
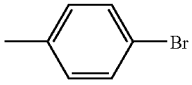
(1)-17
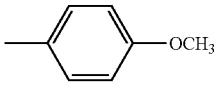
(1)-18
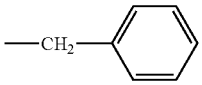
(1)-19
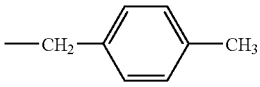
(1)-20
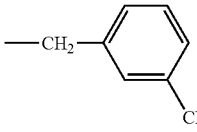
(1)-21 $-(CH_2)3OCH_3$
(1)-22 $-(CH_2)2OCH_3$
(1)-23 $-(CH_2)_3-OCH_3$
(1)-24
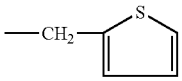
(1)-25
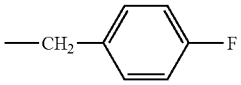
(1)-26
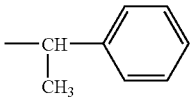
(1)-27
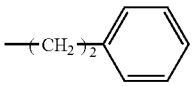
(1)-28
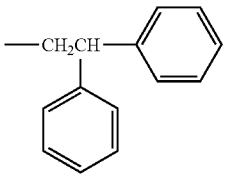
-continued
(1)-29
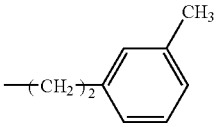
(1)-30
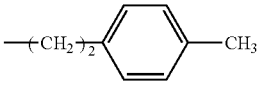
(1)-31
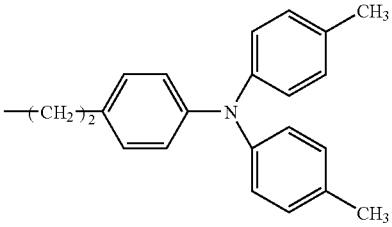
(1)-32
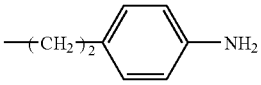
(1)-33
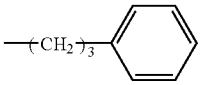
(1)-34
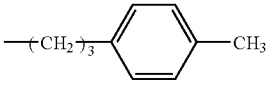
(1)-35
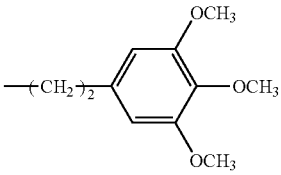
(1)-36
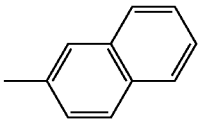
(1)-37
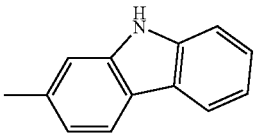
Specific examples are listed below.
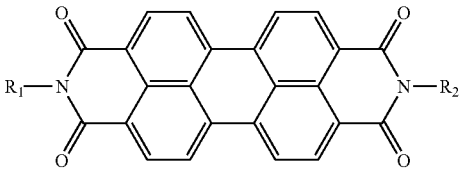
| Compound | R1 | R2 |
|---|---|---|
| 1-1 | (1)-1 | (1)-1 |

-continued
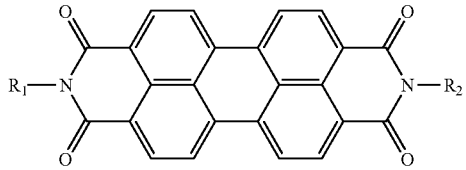
| Compound | R1 | R2 |
|---|---|---|
| 1-2 | (1)-2 | (1)-2 |
| 1-3 | (1)-3 | (1)-3 |
| 1-4 | (1)-6 | (1)-6 |
| 1-5 | (1)-7 | (1)-7 |
| 1-6 | (1)-8 | (1)-8 |
| 1-7 | (1)-10 | (1)-10 |
| 1-8 | (1)-11 | (1)-11 |
| 1-9 | (1)-15 | (1)-15 |
| 1-10 | (1)-18 | (1)-18 |
| 1-11 | (1)-19 | (1)-19 |
| 1-12 | (1)-23 | (1)-23 |
| 1-13 | (1)-24 | (1)-24 |
| 1-14 | (1)-26 | (1)-26 |
| 1-15 | (1)-27 | (1)-27 |
| 1-16 | (1)-30 | (1)-30 |
| 1-17 | (1)-31 | (1)-31 |
| 1-18 | (1)-32 | (1)-32 |
| 1-19 | (1)-33 | (1)-33 |
| 1-20 | (1)-35 | (1)-35 |
| 1-21 | (1)-36 | (1)-36 |
| 1-22 | (1)-37 | (1)-37 |
| 1-23 | (1)-1 | (1)-2 |
| 1-24 | (1)-1 | (1)-3 |
| 1-25 | (1)-1 | (1)-4 |
| 1-26 | (1)-1 | (1)-6 |
| 1-27 | (1)-1 | (1)-10 |
| 1-28 | (1)-1 | (1)-18 |
| 1-29 | (1)-1 | (1)-24 |
| 1-30 | (1)-1 | (1)-36 |
| 1-31 | (1)-2 | (1)-3 |
| 1-32 | (1)-2 | (1)-4 |
| 1-33 | (1)-2 | (1)-5 |
| 1-34 | (1)-2 | (1)-6 |
| 1-35 | (1)-2 | (1)-9 |
| 1-36 | (1)-2 | (1)-10 |
| 1-37 | (1)-2 | (1)-18 |
| 1-38 | (1)-2 | (1)-27 |
| 1-39 | (1)-2 | (1)-36 |
| 1-40 | (1)-2 | (1)-37 |
| 1-41 | (1)-3 | (1)-4 |
| 1-42 | (1)-3 | (1)-10 |
| 1-43 | (1)-3 | (1)-18 |
| 1-44 | (1)-6 | (1)-10 |
| 1-45 | (1)-10 | (1)-18 |
| 1-46 | (1)-18 | (1)-24 |
| 1-47 | (1)-24 | (1)-31 |
| 1-48 | (1)-31 | (1)-35 |
| 1-49 | (1)-35 | (1)-36 |
| 1-50 | (1)-36 | (1)-37 |
Specific examples of the compound represented by
Formula 2
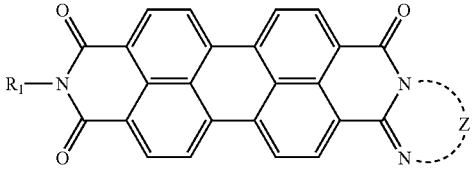
$R_1$ in Formula 2 is the same as that in Formula 1; and examples of the group represented by Z include the following.
(2)-1
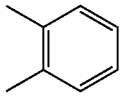
(2)-2
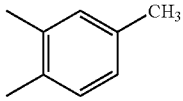
(2)-3
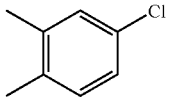
(2)-4
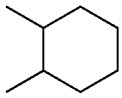
(2)-5
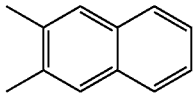
(2)-6
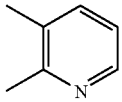
(2)-7
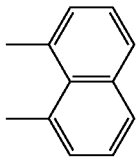
(2)-8
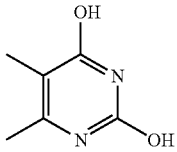
(2)-9
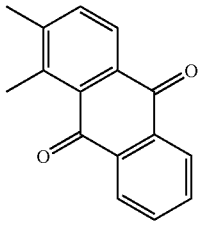
When the compound is a dimer, compounds in which Z represents the following group are preferable.
(2)-10
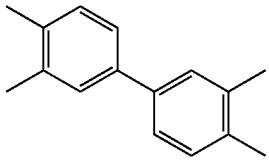

-continued
(2)-11
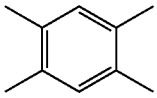
Specific examples are listed below.
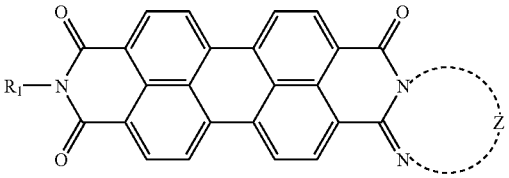
| Compound | R1 | Z |
|---|---|---|
| 2-i | (2)-1 | (2)-1 |
| 2-2 | (2)-2 | (2)-2 |
| 2-3 | (2)-3 | (2)-3 |
| 2-4 | (2)-4 | (2)-4 |
| 2-5 | (2)-5 | (2)-5 |
| 2-6 | (2)-6 | (2)-6 |
| 2-7 | (2)-7 | (2)-7 |
| 2-8 | (2)-8 | (2)-8 |
| 2-9 | (2)-9 | (2)-9 |
| 2-10 | (2)-10 | (2)-10 |
| 2-11 | (2)-11 | (2)-11 |
| 2-12 | (2)-1 | (2)-2 |
| 2-13 | (2)-1 | (2)-3 |
-continued
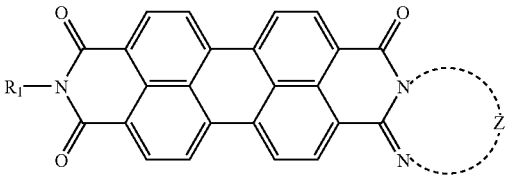
| Compound | R1 | Z |
|---|---|---|
| 2-14 | (2)-1 | (2)-4 |
| 2-15 | (2)-1 | (2)-5 |
| 2-16 | (2)-1 | (2)-6 |
| 2-17 | (2)-1 | (2)-7 |
| 2-18 | (2)-1 | (2)-8 |
| 2-19 | (2)-1 | (2)-9 |
| 2-20 | (2)-2 | (2)-5 |
| 2-21 | (2)-2 | (2)-6 |
| 2-22 | (2)-2 | (2)-7 |
| 2-23 | (2)-2 | (2)-9 |
| 2-24 | (2)-5 | (2)-6 |
| 2-25 | (2)-5 | (2)-7 |
| 2-26 | (2)-5 | (2)-9 |
| 2-27 | (2)-6 | (2)-7 |
| 2-28 | (2)-6 | (2)-9 |
| 2-29 | (2)-7 | (2)-8 |
| 2-30 | (2)-8 | (2)-9 |
Examples of compound represented by Formulas 3a and 3b
(3)-1
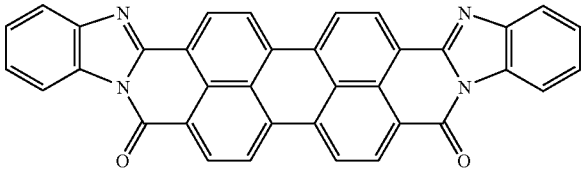
(3)-2
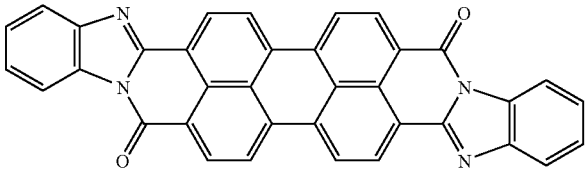
(3)-3
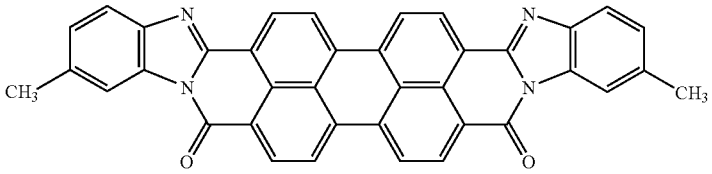
(3)-4
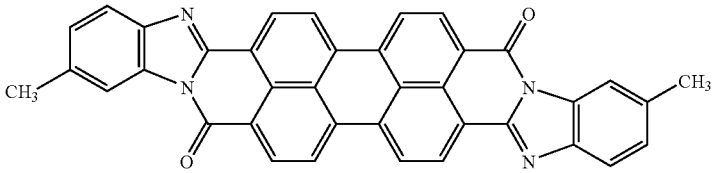

-continued
(3)-5
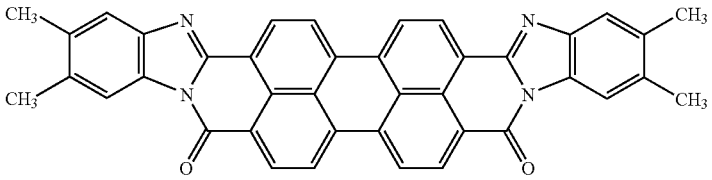
(3)-6
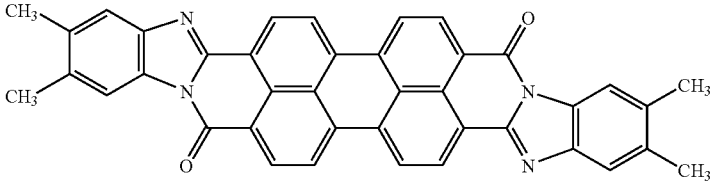
(3)-7
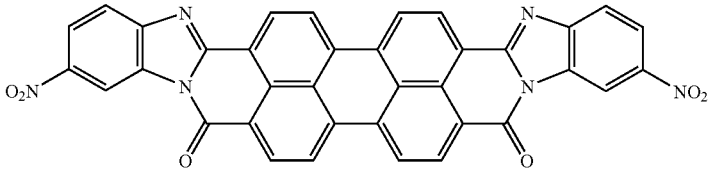
(3)-8
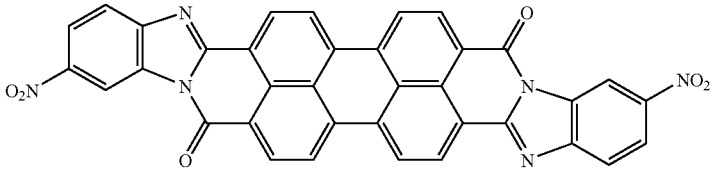
(3)-9
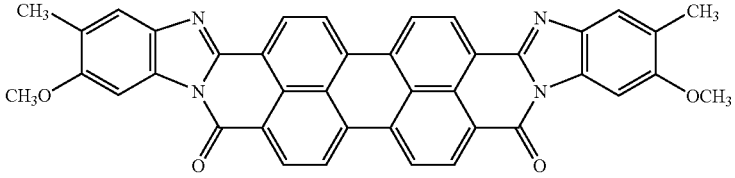
(3)-10
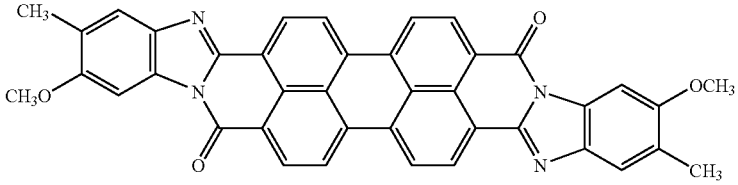
(3)-11
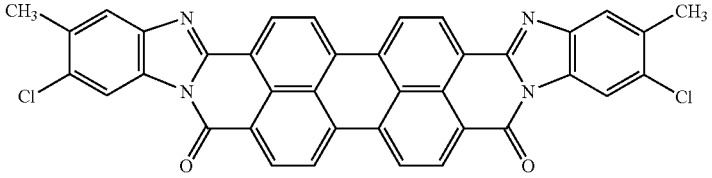
(3)-12
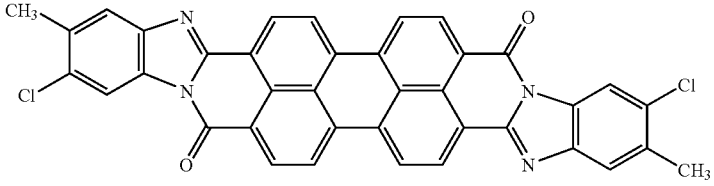

-continued
(3)-13
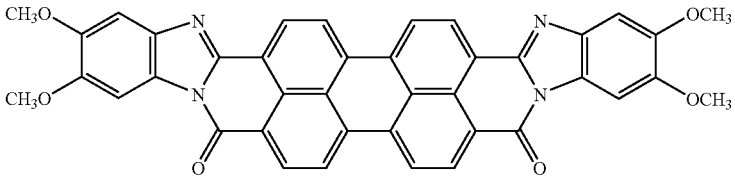
(3)-14
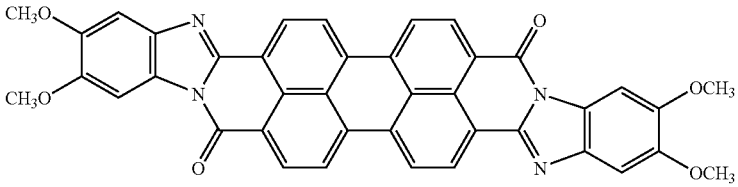
(3)-15
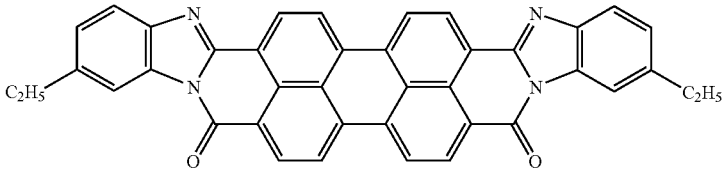
(3)-16
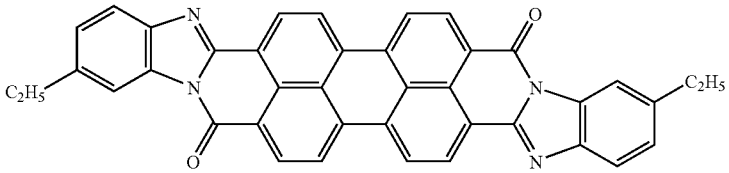
(3)-17
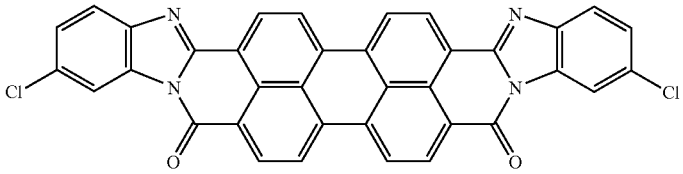
(3)-18
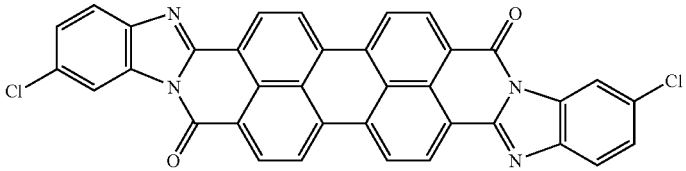
(3)-19
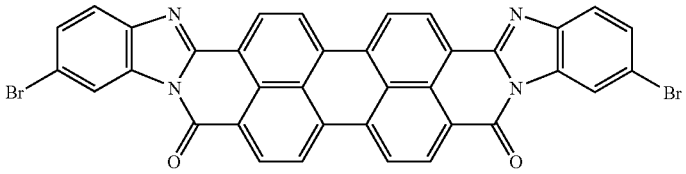
(3)-20
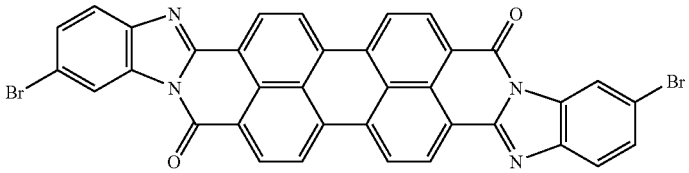

-continued
(3)-21
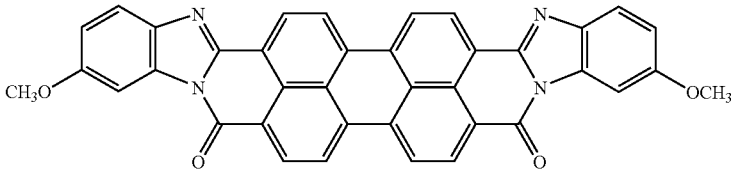
(3)-22
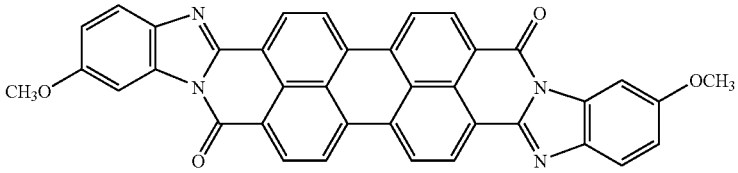
(3)-23
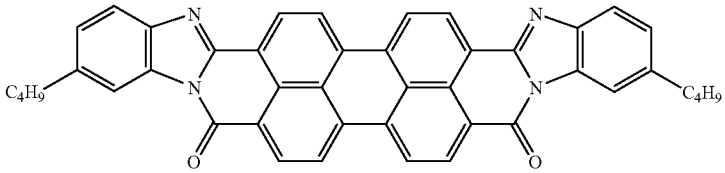
(3)-24
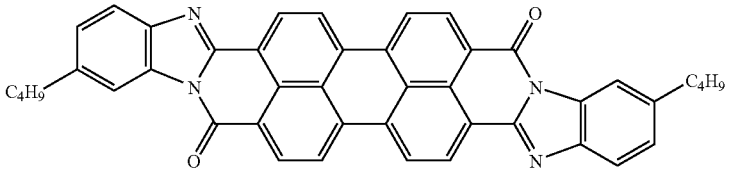
(3)-25
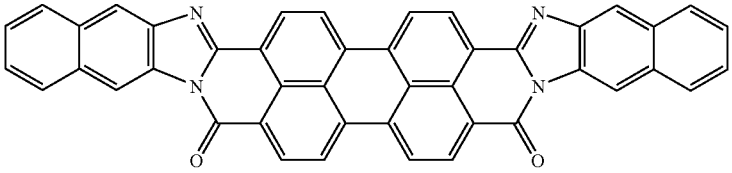
(3)-26
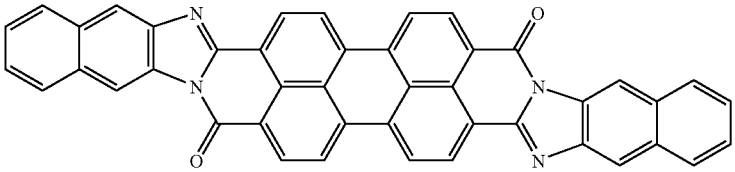
(3)-27
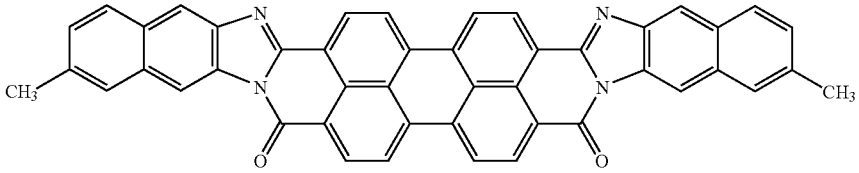
(3)-28
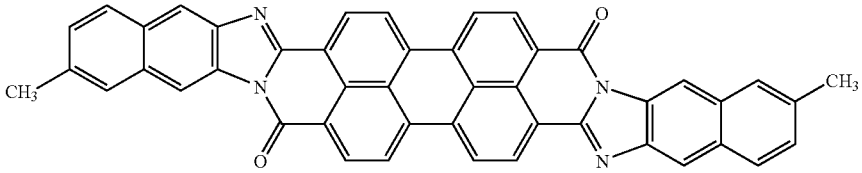

Examples of the N-type charge generation material other than the perylene compounds include an azo compound having a cyano group and a polycyclic quinone pigment.

It is preferable that the charge generation layer according to the invention contains the P-type charge generation material in an amount of less than 10% by weight of the N-type charge generation material. As the P-type charge generation material, any compounds showing the foregoing P-type charge generation property, are usable. Example of the P-type charge generation material includes phthalocyanine compounds, squarilium compounds, azo compounds and perylene compounds. Specific examples are shown.

The thickness of the charge generation layer is decided by considering the following. It is essential that the charge generation layer has a thickness to prevent interference of the laser light; the layer contains a sufficient amount of the charge generation material to reduce the potential by light exposure to obtain suitable image density; and the density of the charged carrier trap is suitably retained in the charge generation layer.

By using q charge generation layer having a relatively high thickness of 0.3 μm or more, a higher sensitivity can be

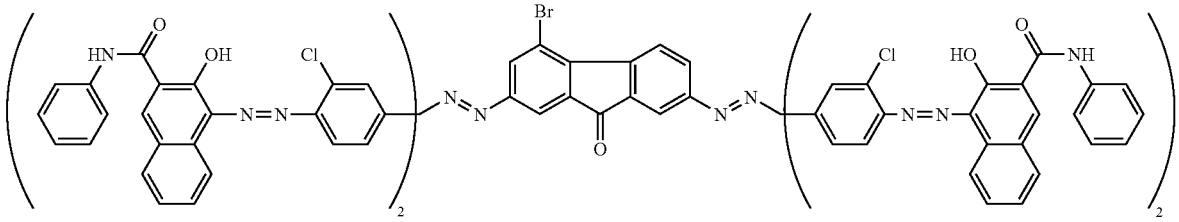

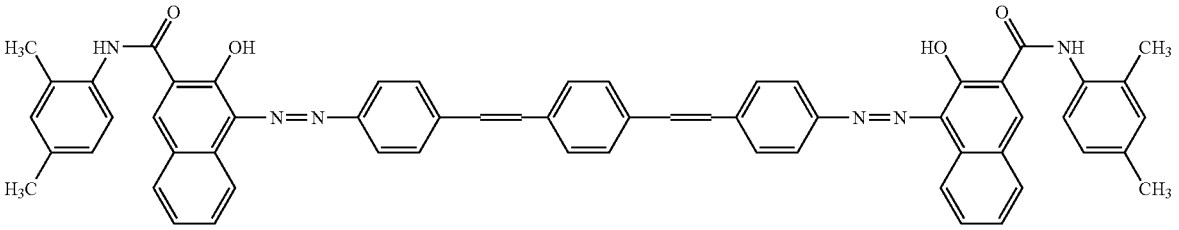

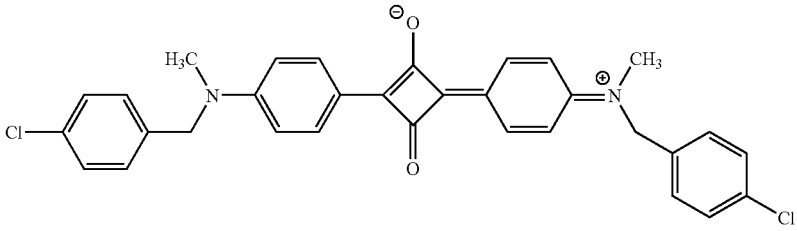

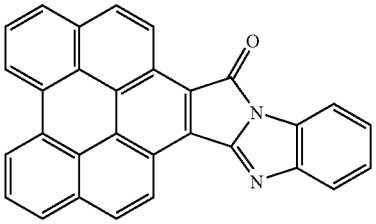

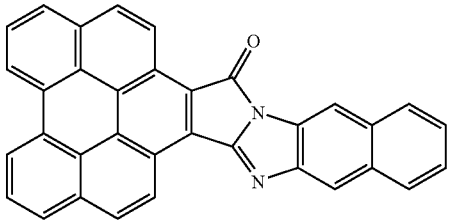

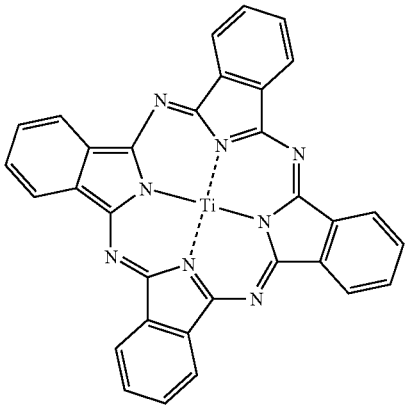

obtained, the interference fringes of laser light can be prevented, and free carriers from the electroconductive substrate can be blocked.

However, when the P-type charge generation material such as the phthalocyanine pigment used in a typical digital copying machine is applied for a thick charge generation layer, the residual potential is raised and unevenness of image caused by light memory tends to occur since the carrier transportation ability of such a charge generating material is low. Accordingly such a charge generation material is difficult to apply for the thick charge generation layer.

The organic photoreceptor of this invention is a negative charge type photoreceptor to form thereon a negatively charged static image which has a charge generation layer containing an N-type charge generation material provided on the electrically conductive substrate and a charge transportation layer or layers containing such charge transportation material and having a total thickness of from 5 to 15 μm provided on the charge generation layer. Electrons generated in the charge generation layer can be moved over a relatively long distance and reach to the electroconductive substrate by making the N-type charge generating material as the principal composition charge generation material of the charge generation layer. Consequently, raising the residual potential caused by electron trapping can be prevented even when a relatively thick layer is employed. Moreover, the occurrence of a moire pattern caused by image irradiation, usually using light in digital image formation such as laser light and LED light can be prevented when the charge generating layer has the aforesaid thickness, since the concentration of the charge generation material can be raised sufficiently. Furthermore, the occurrence of black spotting defect can be considerably reduced since the N-type charge generation material shows a notable effect on the free carrier injection.

The thickness of the charge generation layer to be used in the invention is preferably from 0.3 to 2.0 μm, and is more preferably from 0.3 to 1.5 μm.

It is preferable to incorporate P-type charge generation material together with N-type charge generation material, the amount of the P-type charge generation material preferably less than 10% by weight of N-type charge generation material. Positive hole carriers generated at a deep portion of the charge generation layer can be transported without being trapped in the charge generation layer to the boundary between the charge generation layer and the charge transportation layer by the use of the P-type charge generation layer. Thus the raising of the residual potential is prevented. A more preferable amount of the P-type charge generation material is from 0.5 to 5% by weight. When the amount exceeds 10% by weight, the preventing effect to injection of the free carriers is lowered and black spotting and fogging tend to occur.

Further, the charge transportation layer may be constituted by plural layers as long as the total thickness of the layers is from 5 to 15 μm, preferably from 5 to 10 μm. On such a photoreceptor, the charged potential is stable and sufficient potential can be obtained. Moreover, image defects such as black spotting and unevenness of image density can be prevented, which tend to form when the charge transportation layer is thinned. Therefore, a very sharp image can be formed.

The organic photoreceptor to be applied to the invention is described below.

In the invention, the organic photoreceptor is an electrophotographic photoreceptor in which either or both of the charge generation function or the charge transportation function, each necessary for the photoreceptor, is performed by an organic compound. Examples of such photoreceptors include a photoreceptor containing an organic charge generation material or an organic charge transportation material and a photoreceptor containing a polymer complex having the charge generation function and the charge transportation function.

The charge transportation layer functions to transport the carrier, generated in the charge generation layer by light exposure, to the surface of the organic photoreceptor.

The organic photoreceptor according to the invention is basically a photosensitive layer containing an electroconductive substrate and a charge generation layer and a charge transportation layer provided on that substrate. In the most preferable case, the photosensitive layer is constituted by the charge generation layer and the charge transportation layer.

The organic photoreceptor usable in the invention is described below.

Electroconductive Substrate

The substrate for the organic photoreceptor according to the invention is an substrate in a form of a sheet or cylinder.

The cylindrical organic photoreceptor according to the invention is an organic photoreceptor using a cylindrical electroconductive substrate necessary for endlessly forming an image by rotation. The roundness and the bias of the cylindrical electroconductive substrate are each preferably not more than 0.1 mm, respectively. When the roundness and the bias exceed those ranges, a satisfactory image is difficultly formed.

A drum of metal such as aluminum and nickel, a drum of plastic evaporated with aluminum, tin oxide or indium oxide and a paper or plastic drum coated with an electroconductive substance can be used as the electroconductive material of the substrate. The conductivity of the electroconductive substrate is preferably not more than $10^3$ Ωcm in specific conductance at an ordinary temperature.

Aluminum having the surface which is anodized and sealed may be used as the electroconductive substrate. The anodizing treatment is usually performed in an acidic bath such as chromic acid, sulfuric acid, oxalic acid, phosphoric acid, boric acid and sulfamic acid. Among them, anodizing treatment in sulfuric acid gives the most preferable result. In the case of the anodization in sulfuric acid, a sulfuric acid concentration of from 100 to 200 g/L, an aluminum ion concentration of from 1 to 10 g/L, a liquid temperature of about 20° C. and an applying voltage of about 20 V are preferable. Average thickness of the anodized coat is usually preferably not more than 20 μm, particularly 10 μm or less.

Interlayer

In the present invention, it is possible to provide an interlayer having a barrier function between the electrically conductive substrate and the photosensitive layer.

It is preferred to incorporate titanium oxide particles in the interlayer of low water absorption resin. Size of the titanium oxide particle preferably to be used in the invention is from 10 nm to 200 nm in number average primary particle diameter. An interlayer coating liquid containing the foregoing titanium oxide particles has a high dispersion stability and the formation of the black spot can be sufficiently inhibited by the use of the interlayer formed by such the coating liquid.

The shape of titanium oxide includes a branched-shape, a needle-shape and a granule-shape. The crystal type of the titanium oxide particle having such the shapes includes an anatase-type, a rutile-type and an amorphous-type. Titanium oxide having any shape and any crystal type may be used, and a mixture of two or more kinds of titanium oxide each different from the other in the shape and the crystal type are also may be used. One of the best example is a granule-shape rutile type particle.

In one of the surface treatments to be applied to the titanium oxide particle, plural times of treatments are applied and the last treatment of the plural treatments is carried out by the reactive organic silicon compound. It is preferred that at least on of the foregoing plural times of surface treatments is performed by the use of one or more kinds of compound selected from alumina $Al_2O_3$, silica $SiO_2$ and zirconia $ZrO_2$, and the surface treatment by the reactive organic silicon compound is performed at last.

The surface treatment is a treatment to deposit alumina, silica or zirconia or its hydrate on the surface of the titanium oxide particle. A treatment composition containing a reactive organic silicone compound is employed in the reactive organic silicone surface treatment.

The surface of the titanium oxide particle is uniformly covered by applying two or more times of the surface treatment as above components. The dispersibility of the titanium oxide particle in the interlayer is improved by the use of such the surface-treated titanium oxide particle in the interlayer and a suitable photoreceptor inhibited in the formation of image defect such as the black spot can be produced.

The reactive organic silicon compound is a compound capable of condensation reacting with a hydroxyl group on the surface of the titanium oxide. Preferable examples of the compound are represented by the following Formula 4.

$$(R)_n—Si—(X)_{4-n} \qquad \text{Formula 4}$$

In the above, Si is a silicon atom, R is an organic group which is directly bonded to the silicon atom by the carbon atom thereof, X is a hydrolysable group and n is an integer of from 0 to 3.

Examples of the organic group represented by R which is directly bonded to the silicon atom by the carbon atom thereof include an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy group-containing group such as a γ-glycidoxypropyl group and a β-(3,4-epoxycyclohexyl)ethyl group; a (metha)acryloyl group-containing group such as a γ-acryloxypropyl group and a γ-methacryloxypropyl group; a hydroxyl group-containing group such as a γ-hydroxy propyl group and a 2,3-dihydroxypropyloxypropyl group; a vinyl group-containing group such as a vinyl group and a propenyl group; a mercapto group-containing group such as a γ-mercaptopropyl group; an amino group-containing group such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluorooctylethyl group; and an alkyl group substituted by a nitro group or a cyano group. Examples of the hydrolysable group represented by X include an alkoxyl group such as a methoxy group and an ethoxy group; a halogen atom and an acyloxy group.

The organic silicon compounds represented by Formula 4 may be used singly or in combination.

In the compound represented by Formula 4, when n is 2 or 3, plural groups represented by R may be the same or different from each other when n is 2 or more, and groups represented by X may be the same or different from each other. When two or more kinds of the compound are used, R and X may be the same or different from each other between the different compounds.

The preferable example of the reactive organic silicone compound used for surface treatment is polysiloxane. The polysiloxane having a molecular weight of from 1,000 to 20,000 is easily available and shows a suitable black spot inhibiting ability. Particularly, good effect can be obtained when methylhydrogenpolysiloxane is used for the last surface treatment.

A hydrogenpolysiloxane compound is preferably used as the reactive organic silicon compound to be used in the last surface treatment.

Photosensitive Layer

Charge Generation Layer

An N-type pigment is employed for the charge generation material (CGM) in the charge generation layer.

A resin is used for a binder for a dispersant of CGM in the charge generation layer. Example of the preferable resin includes a formal resin, a butyral resin, a silicone resin, a polyvinylbutyral resin, a phenoxy resin, a polyurethane resin, a phenol resin and a polyester resin, by which residual potential during repeated use can be minimized. The ratio of the binder resin to the charge transfer material is preferably from 10 to 200 parts by weight to 100 parts by weight of the binder resin.

Charge Transfer Layer

Charge transfer layer: the charge transfer layer contains a charge transfer material CTM and a layer-formable binder resin in which the CTM is dispersed. An additive such as an antioxidant may be further contained according to necessity.

A charge transfer material of hole transfer type (P-type) is preferably employed in the CTL. For example, a triphenylamine derivative, a hydrazone compound, a styryl compound, a benzyl compound and a butadiene compound may be used as the charge transfer material CTM. These charge transfer material are usually dissolved in a suitable binder resin to form a layer. Among them, the charge transfer materials capable of minimizing the increasing of the remaining potential accompanied with repetition of use is one having a high electron mobility of not less than $10^{-5}$ $cm^2/V\cdot sec$, and the difference of the ionization potential of such the CTM and that of the CGM to be used in combination with the CTM is preferably not more than 0.5 (eV), more preferably not more than 0.30 (eV).

The ionization potential of the CGM and CTM is measured by a surface analyzer AC-1, manufactured by Riken Keiki Co., Ltd.

Examples of the resin to be used for charge transfer layer CTL include a polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin, a copolymer containing two or more kinds of the repeating unit contained the foregoing resins, and a high molecular weight organic semiconductive material such as poly(N-vinylcarbazole) other than the foregoing insulating resins.

The polycarbonate resin is most preferable as the binder for CTL. The polycarbonate resin is most preferable since the resin simultaneously improves the anti-abrasion ability, the dispersing ability of the CTM and the electrophotographic property of the photoreceptor.

The ratio of the binder resin to the charge transfer material is preferably from 10 to 200 parts by weight to 100 parts by weight of the binder resin.

Examples of the solvent or the dispersing medium to be used for preparing the interlayer, the photosensitive layer and another layer include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,1,2-trichloroethane, 1,1,1-trichloroethane, trichloroethylene, tetrachloroethane, tetrahydrfurane, dioxorane, dioxane, methanol, ethanol, butanol, iso-propanol, ethyl acetate, butyl acetate, dimethylsulfoxide and methyl cellosolve.

The solvent for the interlayer coating composition is not limited thereto. Among them, methanol, ethanol, 1-propanol and iso-propanol are preferably used. The solvents may be used singly or in combination.

Spray coating and coating by a coating amount controlling circular coating means may be used for preparing the photoreceptor including the interlayer. The spray coating and the coating by the coating amount controlling circular coating means such as ring shaped slide hopper coating apparatus are preferably used so as to inhibit dissolution of the under layer as small as possible and to attain uniform coating. The spray coating method is described in JP O.P.I. Nos. 3-90250 and 3-269238 and the coating amount controlling circular coating means is described in JP O.P.I. No. 58-189061.

Toner to be employed in the invention is described below.

As a result of investigation by the inventors of the usual image forming method using a small particle toner, it was found that the developing ability and the cleaning suitability of individual particles tended to differ and the variation of adhesive force to the photoreceptor of individual particles was larger for small particle toner. In the invention, toner comprising toner particles having a particle diameter within the range of from 2 to 8 μm is called minute particle toner.

It was found that the difference of adhesive force to the photoreceptor of individual particles can be reduced by performing the reversal development under a condition of electrical field intensity higher than usual, such as that satisfying the foregoing Expression 1. Thus uniformity of development and cleaning ability of the small particle toner can be improved.

The inventors notice to the 50% diameter or the central value of the diameters of all the toner particles other than the way of simply reducing the content of the small particles which raise the adhesion force. In the analysis of the content of the small particles away from the central value, the diameter at an accumulated frequency of 75% from each of the larger side of the volume particle diameter and the larger side of the number diameter of the toner particles.

Figure 4:
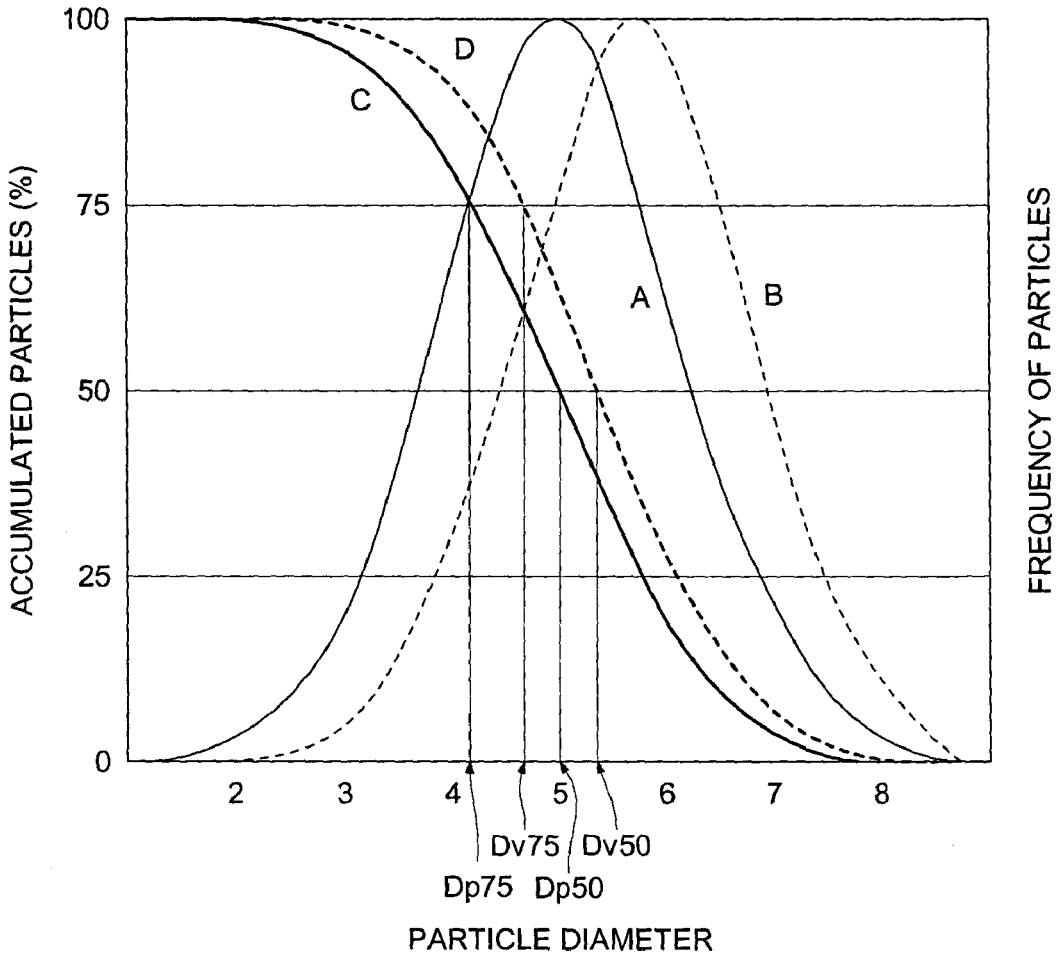
FIG. 4 is schematic graph of a particle distribution of toner.

FIG. 4 demonstrates a schematic view of toner particle distribution. The abscissa axis represents toner particle diameter. Curve A shows distribution of number of toner particles, and curve B shows distribution of volume of toner, wherein the ordinate axis (right) represents frequency of number or volume. Curve C shows accumulated number of particles corresponding to curve A in percent, and curve C shows accumulated volume of particles corresponding to curve B in percent, wherein the ordinate axis (left) represents accumulated number or volume in percent.

Dp50 and Dv50 each is a particle diameter corresponding to 50% accumulated particles calculating from larger particle side of number particle distribution and volume particle distribution, respectively. Dp75 and Dv75 each is a particle diameter corresponding to 75% accumulated particles calculating from larger particle side of number particle distribution and volume particle distribution, respectively.

As above components, a good electrophotographic image with high image density and high sharpness and without the image defects such as black spotting and white spotting can be obtained when the development is performed under a strong electrical field according to the aforesaid Expression 1 by using the toner in which the ratio ($Dv_{50}/Dp_{50}$) of the 50% volume diameter $Dv_{50}$ to the 50% number diameter $Dp_{50}$ of the toner particles is from 1.0 to 1.15, and the ratio ($Dv_{75}/Dp_{75}$) of the 75% volume diameter accumulated from the larger side to the 75% number diameter accumulated from the larger side of the toner particles is from 1.0 to 1.20, and the number of particles each having a particle diameter of not more than $0.7\times Dp_{50}$ is not more than 10% of the whole number of the particles of the toner, and the organic photoreceptor having an electroconductive substrate and the charge generation layer containing N-type charge generation material and a charge transportation layer with a thickness of from 5 to 15 μm is employed as the photoreceptor.

Toner employed in this invention is described. A volume particle diameter, a number particle diameter, ratio thereof are described.

In the present invention, preferable particle size distribution of toner particles is one which is obtained when particles are monodispersed or nearly monodispersed. It is essential that ratio (Dv50/Dp50) is from 1.00 to 1.15, wherein (Dv50) is the 50 percent volume particle diameter and (Dp50) is the 50 percent number particle diameter. The ratio is more preferably from 1.00 to 1.13.

Further, ratio (Dv75/Dp75) is from 1.00 to 1.12, wherein Dv75 is the cumulative 75 percent volume particle diameter from the maximum diameter of the toner particle and Dp75 is the cumulative 75 percent number particle diameter for the purpose of inhibiting fluctuation of development or transfer performance.

Further, the proportion of colored particles, having a particle diameter of at most 0.7×(Dp50), is less than or equal to 10 percent by number and more preferably 5 to 9 percent by number.

The 50 percent volume particle diameter (Dv50) is preferably from 2 to 8 μm, and is more preferably from 3 to 7 μm. The 50 percent number particle diameter (Dp50) is preferably from 2 to 7.5 μm, and is more preferably from 2.5 to 7 μm.

The cumulative 75 percent volume particle diameter (Dv75) or the cumulative 75 number particle diameter from the largest particle, as described herein, refers to the volume particle diameter or the number particle diameter at the position of the particle size distribution which shows 75 percent of the cumulative frequency with respect to the sum of the volume or the sum of the number from the largest particle.

It is possible to determine 50 percent volume particle diameter (Dv50), 50 percent number particle diameter (Dp50), cumulative 75 percent volume particle diameter (Dv75), and cumulative 75 percent number particle diameter (Dp75), employing a Coulter Counter Type TAII or a Coulter Multisizer (both are manufactured by Coulter Inc.).

Components of toner and its preparation method are described.

The toner employed in this invention comprises a colorant and a binder resin. The toner may be prepared by a method in which comprises pulverization and a classification, or so called polymerization method in which resin particles obtained by polymerization are employed for toner preparation. Particularly preferable method is that includes a process of salting out/fusing resin particles in the polymerization method.

A radical polymerizable monomer is used as a component and a cross-lining agent can be used. It is preferable to use at least one of the radical polymerizable monomer having an acid group or a base group.

(1) Radical Polymerizable Monomers

Radical polymerizable monomers are not particularly limited. It is possible to employ conventional radical polymerizable monomers known in the art. Further, they may be employed in combination of two or more types so as to satisfy desired properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Radical Polymerizable Monomers having an Acidic Group or a Basic Group

Employed as radical polymerizable monomers having an acidic group or a basic group may, for example, be amine based compounds such as monomers having a carboxyl group, monomers having a sulfonic acid group, and amine based compounds such as primary, secondary, and tertiary amines, quaternary ammonium salts, and the like.

Listed as radical polymerizable monomers having an acidic group are acrylic acid, methacrylic acid, fumaric acid, maleic acid, itaconic acid, cinnamic acid, monobutyl maleate, monooctyl maleate, and the like as monomers having a carboxyl group.

Listed as monomers having sulfonic acid are styrenesulfonic acid, allylsulfosuccinic acid, octyl allylsulfosuccinate, and the like.

These may be in the form of salts of alkali metals such as sodium or potassium, or salts of alkali earth metals such as calcium and the like.

Listed as radical polymerizable monomers having a basic group are amine based compounds which include dimethyl aminoethyl acrylate, dimethyl aminoethyl methacrylate, diethyl aminoethyl acrylate, diethyl aminoethyl methacrylate, and quaternary ammonium salts of said four compounds; 3-dimethylaminophenyl acrylate, 2-hydroxy-3-methacryloxypropyltrimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride, N,N-diallylethylammonium chloride; and the like.

The content ratio of radical polymerizable monomers having an acidic group or a basic group is preferably 0.1 to 15 percent by weight with respect to the total monomers. The content ratio of radical polymerizable crosslinking agents is preferably 0.1 to 10 percent by weight with respect to the total radical polymerizable monomers.

(Chain Transfer Agents)

For the purpose of regulating the molecular weight of resinous particles, it is possible to employ commonly used chain transfer agents. Said chain transfer agents are not particularly limited, and for example, employed are mercaptans such as octylmercaptan, dodecylmercaptan, tert-dodecylmercaptan, and the like, carbon tetrabromide, styrene dimer, and the like.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (ascorbic acid and the like), which is capable of initiating the polymerization at room temperature, it is possible to carry out polymerization at at least room temperature.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyltriphenylmethane-4,4-diazi-bis-o-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, nonionic surface active agents may be employed. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

These are employed as an emulsifier during the emulsion polymerization process, and further are employed for other purposes or in other processes.

<Colorants>

Listed as colorants which constitute the toner of the present invention may be inorganic pigments, organic pigments, and dyes.

Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

The organic pigments and dyes may be employed.

Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

These organic pigments, as well as dyes, may be employed individually or in combination of selected ones, if desired. Further, the added amount of pigments is commonly between 2 and 20 percent by weight, and is preferably between 3 and 15 percent by weight.

The colorants may also be employed while subjected to surface modification. As said surface modifying agents may be those conventionally known in the art, and specifically, preferably employed may be silane coupling agents, titanium coupling agents, aluminum coupling agents, and the like.

Toner employed in the invention may contain a releasing agent. Preferable examples of the releasing agent include low molecular weight polyolefin wax such as polypropylene and polyethylene, and paraffin wax, Fischer-Tropsch wax, and ester wax. A particularly preferable example is an ester compounds represented by General Formula (5), described below.

$$R^1\text{—}(OCO\text{—}R^2)_n \qquad (1)$$

wherein n represents an interger of 1 to 4, and preferably 2 to 4, more preferable 3 or 4, and in particular preferably 4.

$R^1$ and $R^2$ each represent a hydrocarbon group which may have a substituent respectively. $R^1$ has from 1 to 40 carbon atoms, and preferable 1 to 20, more preferably 2 to 5. $R^2$ has from 1 to 40 carbon atoms, and preferably 13 to 29, more preferable 12 to 25.

The representative examples are listed.

1) $CH_3\text{—}(CH_2)_{12}\text{—}COO\text{—}(CH_2)_{17}\text{—}CH_3$

2) $CH_3\text{—}(CH_2)_{18}\text{—}COO\text{—}(CH_2)_{17}\text{—}CH_3$

3) $CH_3\text{—}(CH_2)_{20}\text{—}COO\text{—}(CH_2)_{21}\text{—}CH_3$

4) $CH_3\text{—}(CH_2)_{14}\text{—}COO\text{—}(CH_2)_{19}\text{—}CH_3$

5) $CH_3\text{—}(CH_2)_{20}\text{—}COO\text{—}(CH_2)_6\text{—}O\text{—}CO\text{—}(CH_2)_{20}\text{—}CH_3$ 6) $CH_3\text{—}(CH_2)_{20}\text{—}COO\text{—}(CH_2)_2\text{—}CH(CH_3)\text{—}CH_2\text{—}O\text{—}CO\text{—}(CH_2)_{20}\text{—}CH_3$ 7) $CH_3\text{—}(CH_2)_{22}\text{—}COO\text{—}(CH_2)_2\text{—}CH(CH_3)\text{—}CH_2\text{—}O\text{—}CO\text{—}(CH_2)_{22}\text{—}CH_3$ 8) $CH_3\text{—}(CH_2)_{22}\text{—}COO\text{—}CH_2\text{—}C(CH_3)_2\text{—}CH_2\text{—}O\text{—}CO\text{—}(CH_2)_{22}\text{—}CH_3$ 9) $CH_3\text{—}(CH_2)_{26}\text{—}COO\text{—}CH_2\text{—}C(CH_3)_2\text{—}CH_2\text{—}O\text{—}CO\text{—}(CH_2)_{26}\text{—}CH_3$ 10) $CH_2\text{—}O\text{—}CO\text{—}(CH_2)_{26}\text{—}CH_3$
$CH\text{—}O\text{—}CO\text{—}(CH_2)_{26}\text{—}CH_3$
$CH_2\text{—}O\text{—}CO\text{—}(CH_2)_{26}\text{—}CH_3$ -continued 11) $CH_2-O-CO-(CH_2)_{22}-CH_3$
$CH-O-CO-(CH_2)_{22}-CH_3$
$CH_2-O-CO-(CH_2)_{22}-CH_3$

12) $CH_2-OH$
$CH-O-CO-(CH_2)_{26}-CH_3$
$CH_2-O-CO-(CH_2)_{26}-CH_3$

13) $CH_2-OH$
$CH-O-CO-(CH_2)_{22}-CH_3$
$CH_2-O-CO-(CH_2)_{22}-CH_3$

14) $CH_2-OH$
$CH-OH$
$CH_2-O-CO-(CH_2)_{26}-CH_3$

15) $CH_2-OH$
$CH-OH$
$CH_2-O-CO-(CH_2)_{22}-CH_3$

16)
$$CH_3-(CH_2)_{26}-COO-CH_2-C(CH_3)(CH_2-O-CO-(CH_2)_{26}-CH_3)(CH_2-O-CO-(CH_2)_{26}-CH_3)$$

17)
$$CH_3-(CH_2)_{20}-COO-CH_2-C(CH_2CH_3)(CH_2-O-CO-(CH_2)_{20}-CH_3)(CH_2-O-CO-(CH_2)_{20}-CH_3)$$

18)
$$CH_3-(CH_2)_{26}-COO-CH_2-C(CH_2-O-CO-(CH_2)_{26}-CH_3)(CH_2-O-CO-(CH_2)_{26}-CH_3)(CH_2-O-CO-(CH_2)_{26}-CH_3)$$

19)
$$CH_3-(CH_2)_{20}-COO-CH_2-C(CH_2-O-CO-(CH_2)_{20}-CH_3)(CH_2-O-CO-(CH_2)_{20}-CH_3)(CH_2-O-CO-(CH_2)_{20}-CH_3)$$

20)
$$CH_3-(CH_2)_{18}-COO-CH_2-C(CH_2-O-CO-(CH_2)_{18}-CH_3)(CH_2-O-CO-(CH_2)_{18}-CH_3)(CH_2-O-CO-(CH_2)_{18}-CH_3)$$

21)
$$CH_3-(CH_2)_{16}-COO-CH_2-C(CH_2-O-CO-(CH_2)_{16}-CH_3)(CH_2-O-CO-(CH_2)_{16}-CH_3)(CH_2-O-CO-(CH_2)_{16}-CH_3)$$

22)
$$CH_3-(CH_2)_{20}-COO-CH_2-C(CH_2-O-CO-CH_3)(CH_2-O-CO-CH_3)(CH_2-O-CO-CH_3)$$

The ester wax is incorporated in resin particles and gives the toner obtained by fusing the resin particles suitable fixing ability.

The releasing agent is added in an amount of between 2 and 20 percent by weight, and is preferably between 3 and 15 percent by weight. The toner used in this invention is preferably prepared by the following process. The releasing agent dissolved in polymerizable monomer is dispersed in water, and they are subjected to polymerization reaction to prepare resin particles containing the releasing agent. The toner is prepared by salting out/fusing the resin particles and colorant particles.

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resinous particles as well as colorant particles so as to be incorporated into the toner, another is one in which said charge control agents are added to resinous particles, and the like.

In the same manner, it is possible to employ various charge control agents, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

<External Additives>

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Fine inorganic particles may be employed. Specifically, it is possible to preferably employ fine silica, titanium, and alumina particles and the like. These fine inorganic particles are preferably hydrophobic. Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by TAYCA CORPORATION; commercially available TA-300SI, TA-500, TAF-130, TAF-510, and TAF-510T, produced by Fuji Titanium Industry Co.Ltd.; commercially available IT-S, IT-OA, IT-OB, and IT-OC, produced by Idemitsu Kosan Co. Ltd.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner. The external additives are added by employing a mixing machine such as a tubular mixer, Henschel mixer, Nauter mixer V-type mixer.

The production method of the toner for developing the static latent image related to this invention is described below.

Production Process

The toner according to the invention is preferably produced by a polymerization process comprising the steps of dispersing the aforesaid polymerizable monomer or a solution of the polymerizable monomer in which a mold releasing agent is dissolved into an aqueous medium, preparing resin particles including a mold releasing agent by polymerization, aggregating the resin particles by fusion in the aqueous medium, separation by filtrating and washing the resultant particles to remove the surfactant, drying the resultant particles, and adding an exterior additive to the dried particles. Thus obtained resin particles may be colored particles or uncolored particles. In the later case, colored particles can be prepared by adding colored particles to the dispersion of the resin particles and adhesion by fusion to the resin particle in the aqueous medium.

For adhesion by fusion, a method is preferred in which the resin particles formed by polymerization are subjected to salting-out/adhesion by fusion. When uncolored resin particles are used, the colored particles can be salted-out/adhered by fusion with the resin particles in the aqueous medium.

"Water based medium", as described in said salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in said salting-out/fusion process by dispersing colorants into a water based medium. Dispersion of colorants is carried out in such a state that the concentration of surface active agents in water is adjusted to at least critical micelle concentration. An oil soluble polymerization initiator can be added in the monomer composition.

Further, colorants may be subjected to surface modification. The surface modification method is as follows. Colorants are dispersed into a solvent, and surface modifiers are added to the resulting dispersion. Subsequently the resulting mixture is heated so as to undergo reaction. After completing said reaction, colorants are collected by filtration and repeatedly washed with the same solvent. Subsequently, the washed colorants are dried to obtain the colorants (pigments) which are treated with said surface modifiers.

Colored particles may be prepared by a method in which a colorant is dispersed in water based medium. The colorant is dispersed preferably in water containing a surfactant having not less than critical micelle concentration (CMC).

Homogenizers to disperse colorants are not particularly limited, and preferably listed are "Clearmix", ultrasonic homogenizers, mechanical homogenizers, Manton-Gaulin and pressure type homogenizers, and medium type homogenizers such as sand grinders, Getzman mill, diamond fine mills and the like. Further, listed as surface active agents may be the same as those previously described.

Surfactants mentioned above can be employed in this process.

The salting-out/fusion process is accomplished as follows. Salting-out agents, containing alkaline metal salts and/or alkaline earth metal salts and the like, are added to water comprising resinous particles as well as colorant particles as the coagulant at a concentration of higher than critical aggregation concentration. Subsequently, the resulting aggregation is heated above the glass transition point of said resinous particles so that fusion is carried out while simultaneously conducting salting-out.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Such a method is employed for controlling the particle distribution as classification, controlling of holding time or temperature during the coalescence, and termination method of coalescence.

In the salting-out/fusion process, it is preferable that hold-over time after the addition of salting-out agents is as short as possible. Namely it is preferable that after the addition of salting-out agents, dispersion containing resinous particles and colorant particles is heated as soon as possible and heated to a temperature higher than the glass transition point of said resinous particles.

The reason for this is not well understood. However, problems occur in which the aggregation state of particles varies depending on the hold-over time after salting out so that the particle diameter distribution becomes unstable and surface properties of fused toner particles fluctuate.

Further, it is required that in the salting-out/fusion process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting-out/fusion, said rate is preferably not more than 15° C./minute.

Further, after the dispersion containing resinous particles and colorant particles is heated to a higher temperature than said glass transition point, it is important to continue the salting-out/fusion by maintaining the temperature of said dispersion for a specified period of time. By so doing, it is possible to effectively proceed with the growth of toner particles (aggregation of resinous particles as well as colorant particles) and fusion (disappearance of the interface between particles. As a result, it is possible to enhance the durability of the finally obtained toner.

It is possible to control the particle diameter specifically by employing di-valent metal salt during the process of coalescence to conduct salting out/fusing. It is assumed that repulsive force increases by employing the di-valent metal salt during the salting out process, whereby dispersion ability of a surfactant is inhibited effectively, and as a result, particle distribution is controlled.

To stop the salting out/adhesion by fusion process, it is preferable to add a mono-valent metal salt. The salting out can be stopped by the addition of such the salt. Thus the presence of excessively large diameter particles and excessively small diameter particles can be inhibited.

In the polymerized toner in which the resin particles are associated or adhered by fusion in the aqueous medium, the shape and the shape distribution of the toner particles can be optionally changed by controlling the flow of the medium and the temperature distribution in the reaction vessel, and further controlling the heating temperature, the rate of stirring and the duration of stirring in the shape controlling process.

Namely, in the polymerized toner in which the resin particles are associated or adhered by fusion in the aqueous medium, a toner having the shape coefficient and the uniform shape distribution of the invention can be prepared by controlling the temperature, rate of stirring and duration of stirring using stirring wings and a stirring vessel capable of making the flow in the reacting vessel to a stratiform and unifying the temperature in the content of the vessel. It is supposed that the shape distribution of the particles adhered by fusion is made uniform since no strong stress is applied to the particles in the course of coagulation and adhesion by fusion (associated or coagulated particles) and the temperature distribution is uniform in the stratified flow in the stirring vessel when the adhesion by fusion of the particles is performed in the stratified flow. Thereafter, the adhered particles are gradually made sphere by heating and stirring in the shape controlling process. Thus the shape of the toner particles can be optimally controlled.

It is preferable for controlling the toner to a designated shape to progress the salting out and the adhesion at the same time. The distribution of the particle shape tends to be extended and formation of the small particles cannot be inhibited by a method in which heating is applied after the formation of the coagulated particles. It is assumed that small particles tend to form by breakup of the coagulated particle since the coagulated particles are stirred while heated.

Developer employed in this invention is described.

In such case that the toner is used as a two-component developer by blending with carrier, magnetic particles of the carrier such as metals such as iron, ferrite, magnetite, and the like, alloys of said metals with aluminum, lead and the like are employed. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle size distribution measurement apparatus "Helos", produced by Sympatec Co., which is provided with a wet type. homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

An image forming method and an image forming apparatus with reversal development are described.

The reversal development is mainly employed in the digital type image forming method, wherein an image portion such as characters or figures is exposed to light to form a latent image on a photoreceptor, and the exposed portion is developed by a toner to form an image.

An electric field strength of the organic photoreceptor is an electric field strength of the photoreceptor at unexposed area, which is a value of charged potential at the unexposed area divided by a thickness of the sensitive layer of the photoreceptor.

FIG. 1 is a cross-sectional view of an image forming apparatus showing an image forming method of the present invention. In FIG. 1, numeral 50 is a photoreceptor drum (a photoreceptor) which works as an image holding body. The aforesaid photoreceptor is prepared by applying an organic photosensitive layer to a cylindrical substrate and further applying the resinous layer of the present invention thereon. The photoreceptor is grounded and is subjected to driven rotation in the clockwise direction. Numeral 52 is a scorotron charging unit which results in uniform charging on the circumferential surface of photoreceptor drum 50. Prior to charging employing aforesaid charging unit 52, in order to eliminate the hysteresis of the photoreceptor due to the previous image formation, the circumferential surface of the photoreceptor may be subjected to charge elimination through exposure using exposure section 51 comprising light-emitting diodes and the like.

After uniformly charging the photoreceptor, based on image signals, image exposure is carried out employing image exposure unit 53. In image exposure unit shown in FIG. 1, laser diodes (not shown) are employed as an exposure light source. The photoreceptor is scanned employing light which has been deflected by reflection mirror 532 after passing through rotating polygonal mirror 531 and an fθ lens, whereby electrostatic latent images are formed.

In the invention, the potential of the unexposed area is a surface potential at the area not exposed to image exposing light after being uniformly charged by charging device 52; and the potential of the exposed area is the potential of the area exposed to the image exposing light. The potential exposure may be performed by a potential sensor 547 arranged at the position of development.

Thereafter, the static latent image is developed in the developing device in the developing process. Developing device 54 containing a developer composed of the carrier and the toner is provided on the photoreceptor drum 50, and development is performed by a developing sleeve 541 including a magnet which is rotated while holding the developer. The interior of the developing device 54 is constituted by a developer stirring and conveying members 544 and 543 and a conveying amount controlling member 542. The developer is stirred and conveyed and supplied to the sleeve. The supplying amount of the developer is controlled by the conveying amount controlling member 542. The conveying amount of the developer is usually from 20 to 200 mg/cm$^2$ even though the amount varis depending on the line speed of the electrophotographic organic photoreceptor and the specific gravity of the developer.

The developer comprises a carrier, for example, one composed of ferrite as the core coated with insulating resin and a toner comprising color particles composed of styrene-acryl resin as a principal component, a colorant such as carbon black, a charge controlling agent and low molecular weight polyolefin and silica or titanium oxide added as an external additive. The developer is conveyed into the developing zone while controlling the layer thickness and development is conducted. During the development, direct current bias and, according to need, alternative current bias is applied to developing sleeve 541. Development is performed in either state of the developer of contact or non-contact with the photoreceptor surface.

Recording paper P is supplied into the transferring zone by rotation of paper supplying roller 57 synchronous with the timing of image transfer.

In the transfer zone, a transferring electrode or transferring device 58 is synchronously pressed onto the surface of photoreceptor drum 50 and the image is transferred to the supplied recording paper P while passing between the electrode and the drum.

Then recording paper P is discharged by separation electrode 59 which contacts to the photoreceptor drum at almost the same time as the transfer roller, separated from the surface of photoreceptor drum 59 and conveyed to a fixing device 60. In the fixing device the toner transferred onto the recording paper is molten and fixed onto the recording paper by heating and pressing by a heating roller 601 and pressing roller 602. Thereafter, recorded paper P is ejected from the apparatus through use of an output roller 61. The transfer electrode 58 and separation electrode 59 are released from the surface of the photoreceptor drum 50 after passage of recording paper P in preparation for the next toner image formation.

After separation of recording paper P, the surface of the photoreceptor drum is cleaned by removing the toner remaining thereon by blade 621 of cleaning device 62 pressed to the photoreceptor surface. Then the drum surface is discharged by pre-exposing device 51 and re-charged by charging device 52 for the next image forming process.

Figure 2:
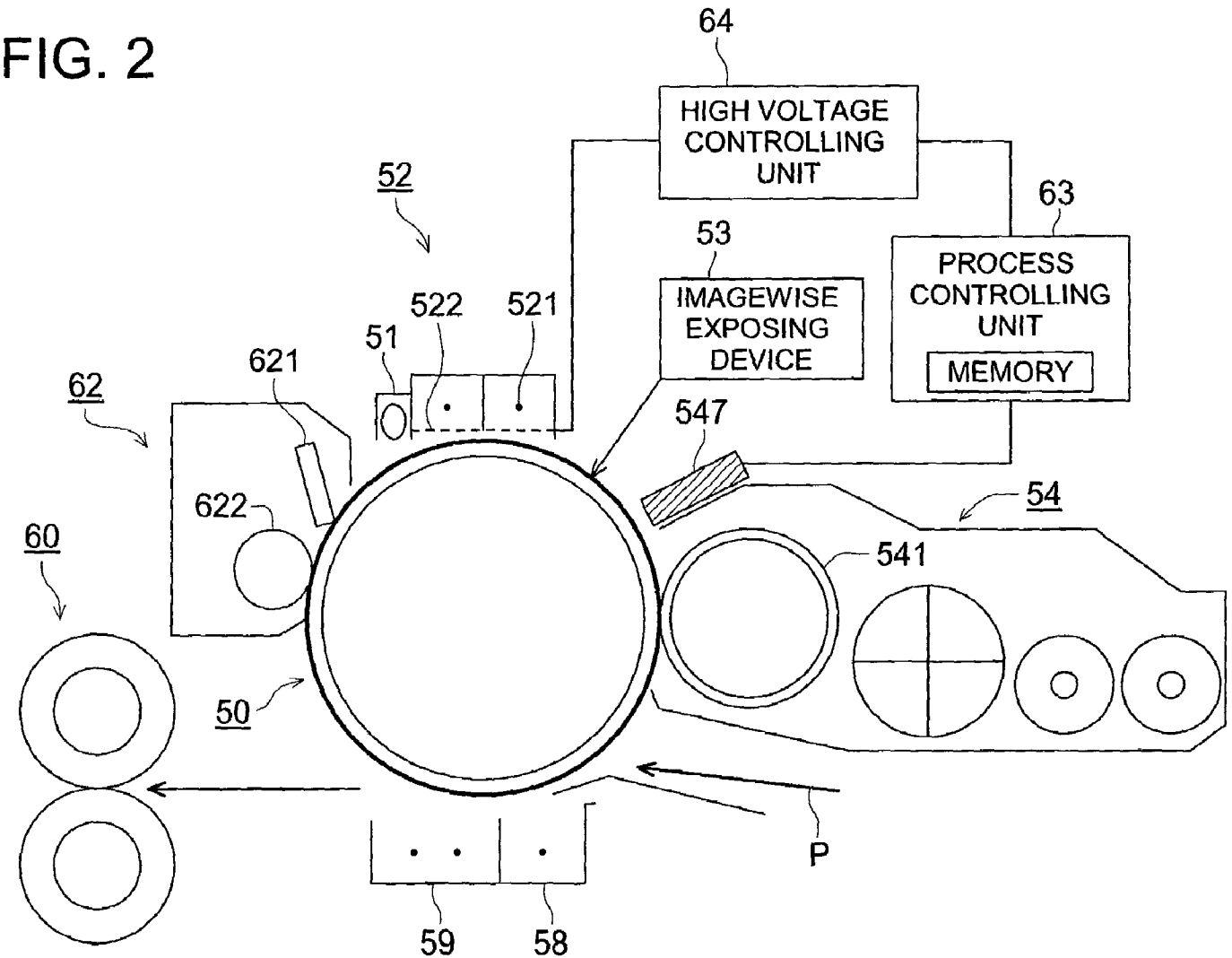
FIG. 2 is enlarged drawing of the constitution of the charge potential controlling unit for the photoreceptor drum.

FIG. 2 is an enlarged drawing of the constitution of the charging potential controlling means for photoreceptor drum 50.

In the invention, electrical field intensity E (V/μm) applied to the organic photoreceptor during development is a quotient of potential V in the unexposed area of the photoreceptor at a time of development divided by layer thickness μm of the photoreceptor. The method for measuring the potential in the unexposed area and the charged potential controlling process for compensating for the potential in the unexposed area are described below referring to FIG. 2.

Initially, the surface of photoreceptor 50 is uniformly charged by charging device 52. The photoreceptor is imagewise exposed to light based on digital signals by laser diode exposing device 53 forming an unexposed area. The surface potential in the unexposed area is detected by potential sensor 547. The detected potential signal is conveyed to a process control means 63, shown in FIG. 2. Process controlling means 63 is a process controlling device for controlling the charging electrode according to the potential signal from potential sensor 547. The controlling device compares potential signal from the potential sensor for the objective potential and determines a compensation signal to compensate for any difference between them to attain the objective potential. The high voltage controlling unit 64 is a high voltage controlling unit for supplying electrical current and voltage to charging electrode 52 according to the controlling signal from process controlling means 63. Compensation signals for charging current and charging grid voltage according to the compensation signal determined as above are conveyed to the high voltage controlling unit, and then the compensated charging current and charging grid voltage are each output from the high voltage controlling unit to corona wire 251 and scorotron grid 522 of charging device 52, respectively. The potential at the position of the potential sensor or the unexposed area potential can be compensated for by the objective potential by repeating the foregoing procedure several times.

It is preferable that the potential sensor is located at the developing position of the photoreceptor, the developing device may be removed if it is necessary, for exact measurement of the unexposed area potential at the developing position on the photoreceptor. When the position of the potential sensor is located away from the developing position, the potential is compensated for based on the calculated value of the dark decay of the potential between the potential sensor and the developing position.

The developing position is the position where the latent image on the photoreceptor is developed, in concrete terms, the position where the photoreceptor and the developing sleeve are closest is considered as the center of the developing position. In the invention, the unexposed area potential at the developing position is the unexposed area potential at the position where the photoreceptor is closest to the developing sleeve.

For reversal development of the invention, the following method is preferably applied for determining the objective value of the unexposed area potential even though various other methods are applicable. Such a method is described below with referring to FIG. 3.

Figure 3:
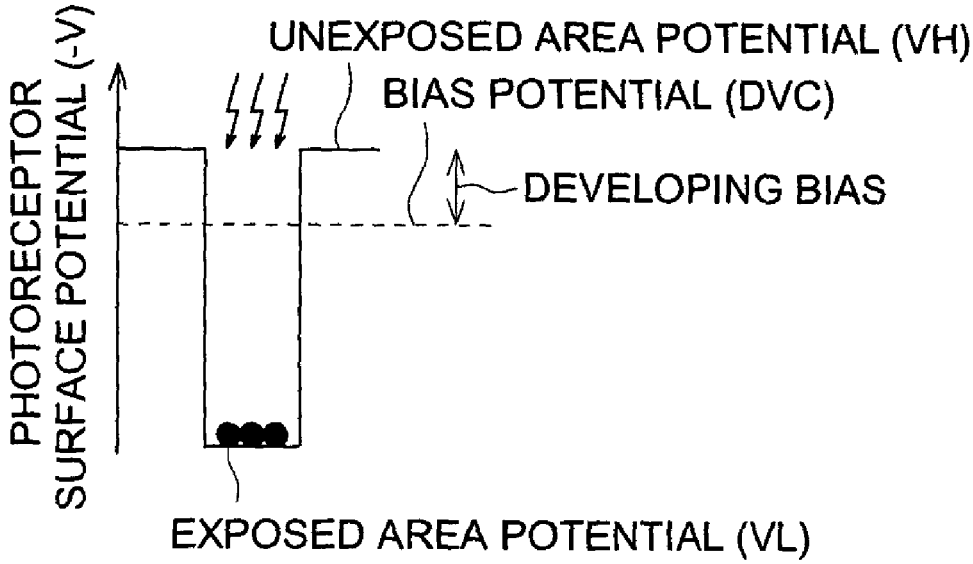
FIG. 3 is a drawing describing the setting method of objective unexposed area potential.

The photoreceptor is subjected to charging and post-exposure at the first use of the printer of the copy machine every day or every designated number of copying, and the exposed area potential VL after the post-exposure is measured as shown in FIG. 3. After that the developing bias potential VDC dominating the image density is determined based on the VL and the unexposed area potential to prevent fogging is set based on the VDC.

Reversal development according to the invention is conducted under the condition in which electrical field intensity E is satisfied as in aforesaid Expression 1. Sufficient development can be attained and a good electrophotographic image without image defects such as the black spotting and the white spotting can be formed when the organic photoreceptor according to the invention having a charge generation layer which contains N-type charge generation material therein and the charge transportation layer with a thickness of from 5 to 15 μm is subjected to the reversal development under the condition of an electrical field intensity E satisfying Expression 1 even if the developer comprising the small diameter toner particles is used. In the case that electrical field intensity E is beyond the range of Expression 1, developability tends to be lowered when E in V/μm is less than 50 and image density and gradation tend to be degraded. Besides, the image defects such as the black spotting and the white spotting tend to form when the electrical field intensity E in V/μm is more than 100. The electrical field intensity is preferably from 60 to 90 V/μm.

In the invention, the distance Dsd between the organic photoreceptor and the developing sleeve carrying the developer is preferably from 350 to 800μm, and the ratio of the line speed of the photoreceptor to that of the developing sleeve is from 1:1 to 1:3. When the Dsd exceeds 800 μm, the developing electrical field intensity is insufficient and the developability is lowered.

EXAMPLES

The present invention is described in detail below referring examples. However the embodiment of the invention is not limited to the examples. In the followings, "part" means "part by weight".

Preparation of Photoreceptor 1

Photoreceptor 1 was prepared in the following manner.

The surface of a cylindrical aluminum substrate was treated to prepare an electroconductive substrate having a surface roughness, Rz, of 1.5 μm.

Interlayer

The following dispersion for an interlayer was diluted by a factor of 2 by a mixed solvent the same as the solvent in the dispersion. After standing for one night, the resultant was filtered used Ridimesh 50 μm filter, produced by Nihon Pall Ltd., to prepare an interlayer coating liquid.

Polyamide resin CM8000 (Toray Co., Ltd.) 1 part

Titanium oxide treated with silica-alumina and methylhydrogenpolysiloxane, number average

| | |
|---|---|
| particle diameter: 35 nm | 3 parts |
| Methanol | 10 parts |

The above components were dispersed for 10 hours by a batch method employing a sand mill, whereby the interlayer coating liquid was prepared.

The above-obtained coating liquid was coated onto the substrate so that the dried layer thickness was 1.0 μm.

| | |
|---|---|
| Charge generation layer: CGL | |
| Charge generation material (CGM) | |
| N-type pigment: Perylene Pigment A | 60 parts |
| P-type pigment: Titanylphthalocyanine pigment F (titanylphthalocyanine pigment having apparent peaks at Bragg's angle 2θ of 7.5° and 28.6° in a Cu—Kα diffraction spectrum) | 0.6 parts |
| Polyvinyl butyral resin BL-S (SEKISUT CHEMICAL Co., LTD.) | 700 parts |
| 2-butanone | 2000 parts |

The above components were mixed and dispersed for 30 hours in a sand mill to prepare a charge generation layer coating liquid. The coating liquid was coated on the interlayer by a dipping coating method to form a 0.5 μm charge generation layer.

| | |
|---|---|
| Charge transportation layer: CTL | |
| Charge transportation material: 4,4'-dimethyl-4''-(α-phenylstyryl)triphenylamine | 225 parts |

-continued

| | |
|---|---|
| Polycarbonate resin Z300 (Mitsubishi Gas Kagaku Co., Ltd.) | 300 parts |
| Antioxidant: IRGANOX 1010 (Nihon Ciba-Geigy Co., Ltd.) | 6 parts |
| Dichloromethane | 2000 parts |
| Silicone oil KF-54 (Shin-Etsu Kagaku Co., Ltd.) | 1 part |

The above components were mixed and dissolved to prepare a charge transportation layer coating liquid. The coating liquid was coated onto the charge generation layer using a dip coating method and dried at 110° C. for 70 minutes to form a 10 μm charge transportation, whereby Photoreceptor 1 was prepared.

Preparation of Photoreceptors 2–8

Photoreceptors 2–8 were prepared in the same manner as Photoreceptor 1 except that the kind of titanium oxide in the interlayer, the thickness of charge generation layer CGL and that of charge transportation layer CTL were changed as shown in Table 1.

Preparation of Photoreceptors 9–12

Photoreceptors 9–12 were prepared in the same manner as Photoreceptor 1 except that Perylene Pigment A in the charge generation layer was replaced by N-type Pigments B-E, and the amount of Titanylphthalocyanine Pigment F was changed to 3.6 parts.

Preparation of Photoreceptor 13

Photoreceptor 13 was prepared in the same manner as Photoreceptor 1 except that Titanylphthalocyanine Pigment F was omitted.

Preparation of Photoreceptor 14

Photoreceptor 14 was prepared in the same manner as Photoreceptor 1 except that Perylene Pigment A in the charge generation layer was replaced by P-type Titanylphthalocyanine Pigment F.

The N-type or P-type of the pigment used in the examples was determined by the aforesaid method. The binder used in such the test was polyvinyl butyral resin BL-S, produced by Sekisui Kagaku Co., Ltd., which was the same as that used for the charge generation layer.

TABLE 1

| | Interlayer | | | | Charge generation layer | | Charge transportation layer | |
|---|---|---|---|---|---|---|---|---|
| Photoreceptor No. | Titanium oxide | Number average diameter of titanium oxide (nm) | Surface treatment of titanium oxide | Thickness of interlayer (μm) | CGM | Layer thickness (μm) | Layer thickness (μm) | Total layer thickness (μm) |
| 1 | Titanium oxide | 35.0 | A | 1.0 | A + F | 0.5 | 10.0 | 11.5 |
| 2 | Titanium oxide | 35.0 | A | 1.0 | A + F | 0.5 | 15.0 | 16.5 |
| 3 | Titanium oxide | 35.0 | A | 1.0 | A + F | 0.5 | 5.0 | 6.5 |
| 4 | Titanium oxide | 35.0 | A | 1.0 | A + F | 0.5 | 16.0 | 17.5 |
| 5 | Titanium oxide | 35.0 | A | 1.0 | A + F | 0.5 | 4.0 | 5.5 |
| 6 | Titanium oxide | 70.0 | B | 1.0 | A + F | 0.3 | 13.0 | 14.3 |
| 7 | Titanium oxide | 140.0 | C | 1.0 | A + F | 1.0 | 13.0 | 15.0 |

TABLE 1-continued

| | Interlayer | | | | Charge generation layer | | Charge transportation layer | |
|---|---|---|---|---|---|---|---|---|
| Photoreceptor No. | Titanium oxide | Number average diameter of titanium oxide (nm) | Surface treatment of titanium oxide | Thickness of interlayer (μm) | CGM | Layer thickness (μm) | Layer thickness (μm) | Total layer thickness (μm) |
| 8 | Titanium oxide | 35.0 | A | 1.0 | A + F | 2.0 | 13.0 | 16.0 |
| 9 | Titanium oxide | 35.0 | A | 1.0 | B + F | 0.5 | 13.0 | 14.5 |
| 10 | Titanium oxide | 35.0 | A | 1.0 | C + F | 0.5 | 13.0 | 14.5 |
| 11 | Titanium oxide | 35.0 | A | 1.0 | D + F | 0.5 | 13.0 | 14.5 |
| 12 | Titanium oxide | 35.0 | A | 1.0 | E + F | 0.5 | 13.0 | 14.5 |
| 13 | Titanium oxide | 35.0 | A | 1.0 | A | 0.5 | 13.0 | 14.5 |
| 14 | Titanium oxide | 35.0 | A | 1.0 | F | 0.5 | 13.0 | 14.5 |

In Table 1, Treatments A, B and C of the micro particles were each the following treatment, respectively:

A: Silica-alumina treatment and methylhydrogenpolysiloxane treatment

B: Silica-alumina treatment and octyltrimethoxysilane treatment

C: Silica-zirconia treatment and Methyltrimethoxysilane treatment

The chemical structures of Perylene Pigments A through D, Diazo Pigment E and Titanylphthalocyanine Pigment E are shown below.

A

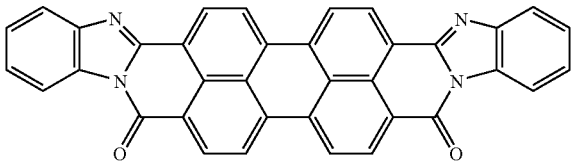

+

-continued

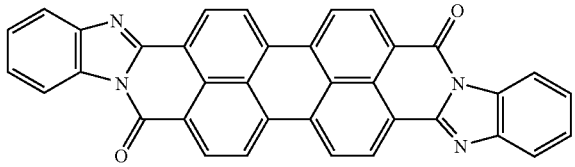

(A mixture of the above compounds)

B

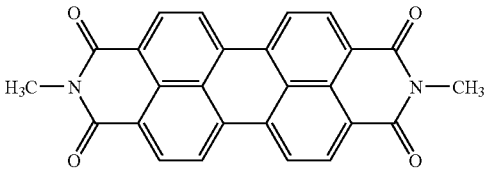

C

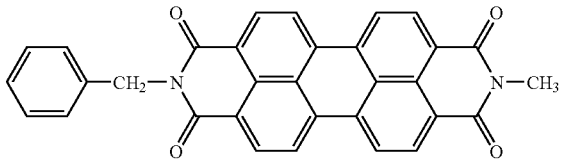

D

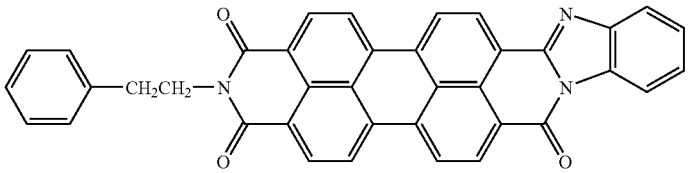

-continued

E

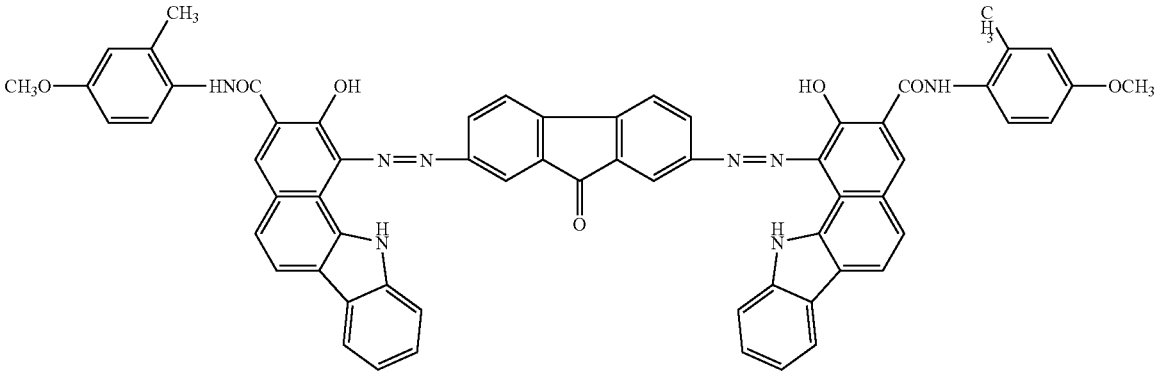

F

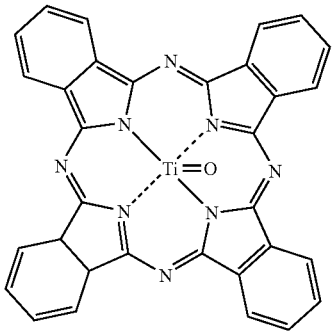

Developer

Preparation of Latex 1

A solution composed of 2760 g of purified water and 7.08 g of an anionic surfactant, sodium dodecylbenzenesulfonate, was placed into a 5000 ml separable flask on which a stirrer, temperature sensor, cooler and nitrogen gas introducing device were attached. Then the contents of the flask were heated to 80° C. while stirring at a rate of 230 rpm under the flow of nitrogen gas. Alternatively, 72.0 g of Exemplified Compound 10 was put into a monomer liquid composed of 115.1 g of styrene, 42.0 g of n-butyl acrylate, and 10.9 g of methacrylic acid and dissolved by heating at 80° C. The heated monomer liquid was placed into the flask and mixed with the surfactant solution after which it was dispersed by a mechanical dispersing machine having a cycling circuit to form emulsified particles of a uniform diameter. Then a solution of 0.48 g of a polymerization initiator, potassium persulfate (KPS), dissolved in 200 g of deionized water, was added to the emulsion. The resulting liquid was heated and stirred at 80° C. for 3 hours to prepare latex particles. Thereafter, a solution of 0.84 g of the polymerization initiator KPS, dissolved in 240 ml of deionized water, was added to the above-prepared latex. After 15 minutes, a mixture of 383.6 g of styrene, 140.0 g of n-butyl acrylate, 36.4 g of methacrylic acid and 14.0 g of n-octyl 3-mercaptopropionate was gradually dripped into the latex over 120 minutes at 80° C. After completion of the dropping, the resulting liquid was further heated and stirred for 60 minutes and then cooled to 40° C. to obtain a latex.

These latex particles are referred to as Latex 1.

Preparation of Colored Particles

Preparation of Colored Particles 1Bk

In 160 ml of deionized water, 9.2 g of sodium n-dodecylsulfate was dissolved with stirring. Into this solution, 20 g of carbon black REGAL 330R, produced by Cabot Co., Ltd., was gradually added while stirring and dispersed in a dispersing machine CLEAMIX. The particle size of the dispersed particles measured by an electrophoresis scatter light meter ELS-800, manufactured by Ootsuka Denshi Co., Ltd., was 112 nm in weight average particle diameter. This dispersion is referred to as Colorant Dispersion 1.

Into a 5 liter four-mouth flask, to which a temperature sensor, cooler, nitrogen gas introducing device and stirrer were attached, 1250 g of Latex 1, 2000 ml of deionized water and Colorant Dispersion 1 were placed, and then stirred. After adjusting the temperature to 30° C., pH value of the mixture was adjusted to 10.0 by adding a 5 moles/liter sodium hydroxide solution. Then a solution of 52.6 g of magnesium chloride hexahydrate dissolved in 72 ml of deionized water was added at 30° C. over 5 minutes while stirring. The resultant was stood for 2 minutes and heated to 50° C. over 5 minutes; the temperature raising rate was 12° C./minute. In such a situation, the particle size was measured by Coulter Counter TA III and the growth of the particles was stopped by adding a solution of 115 g of sodium chloride dissolved in 700 ml of deionized water at the time when the volume average diameter of the particles reached 4.3 μm. The mixture was further stirred for 8 hours at a temperature of 85° C.±2° C. for salting off/adhesion by fusion of the particles. Thereafter, the system was cooled to 30° C. at a cooling rate of 6° C./minute; then the pH was adjusted to 2.0 by addition of hydrochloric acid, and stirring was stopped. Thus formed colored particles were filtered and washed, and dried by air heated to 40° C. The thus obtained colored particles are referred to as Colored Particles 1Bk.

Preparation of Colored Particles 2Bk, 3Bk, 4Bk and 5Bk

Colored Particles 2Bk through 5Bk were prepared in the same manner as Colored Particles Bk1 except that the preparation condition was changed as shown in Table 1.

Preparation of Colored Particles 6Bk Through 8Bk

Colored Particles 6Bk through 8Bk were prepared in the same manner as Colored Particles 1Bk except that the preparation condition was set as shown in Table 2, and the particle growth was stopped when the volume average particle diameter reached 3.8 μm.

Preparation of Colored Particles 9Bk through 11Bk

Colored Particles 9Bk through 11Bk were prepared in the same manner as Colored Particle 1Bk except that the preparation conditions were set as shown in Table 2, and the particle growth was stopped when the volume average particle diameter reached 5.5 μm.

The preparation conditions of Colored Particles 1Bk through 11Bk are shown in Table 2.

TABLE 2

| Colored Particle No. | Added amount of magnesium chloride (g) | Temperature raising rate (° C./minute) | Salt off/adhesion by fusion: Temperature of suspension | Salt off/adhesion by fusion: Duration time (hour) |
|---|---|---|---|---|
| Colored Particles 1Bk | 52.6 | 12 | 85 ± 2° C. | 8 |
| Colored Particles 2Bk | 52.6 | 20 | 90 ± 2° C. | 6 |

TABLE 2-continued

| Colored Particle No. | Added amount of magnesium chloride (g) | Temperature raising rate (° C./minute) | Salt off/adhesion by fusion: Temperature of suspension | Salt off/adhesion by fusion: Duration time (hour) |
|---|---|---|---|---|
| Colored Particles 3Bk | 52.6 | 5 | 90 ± 2° C. | 6 |
| Colored Particles 4Bk | 26.3 | 12 | 85 ± 2° C. | 8 |
| Colored Particles 5Bk | 78.9 | 12 | 85 ± 2° C. | 8 |
| Colored Particles 6Bk | 52.6 | 12 | 85 ± 2° C. | 8 |
| Colored Particles 7Bk | 43.3 | 12 | 85 ± 2° C. | 8 |
| Colored Particles 8Bk | 78.9 | 12 | 85 ± 2° C. | 8 |
| Colored Particles 9Bk | 52.6 | 12 | 85 ± 2° C. | 8 |
| Colored Particles 10Bk | 35.5 | 12 | 85 ± 2° C. | 8 |
| Colored Particles 11Bk | 78.9 | 12 | 85 ± 2° C. | 8 |

Preparation of Colored Particles 12Bk

Colored Particles 12Bk was prepared in the same manner as in Colored Particles 1Bk except that the particle growth was stopped at the time when the volume average particle diameter reached 7.3 μm.

Physical properties of Colored Particles 1Bk through 12Bk are shown in Table 3.

TABLE 3

| Colored Particle No. | 50% volume average particle diameter ($Dv_{50}$) (μm) | 50% number average particle diameter ($Dp_{50}$) (μm) | Dv50/Dp50 | Accumulated 75% volume average particle diameter ($Dv_{75}$) (μm) | Accumulated 75% number average particle diameter ($Dp_{75}$) (μm) | Dv75/Dp75 | Number-% of particles having not more than $0.7 \times Dp_{50}$ |
|---|---|---|---|---|---|---|---|
| Colored Particle 1Bk | 4.6 | 4.3 | 1.07 | 4.1 | 3.7 | 1.11 | 7.8 |
| Colored Particle 2Bk | 4.8 | 4.5 | 1.07 | 4.2 | 3.7 | 1.14 | 5.5 |
| Colored Particle 3Bk | 4.5 | 4.1 | 1.1 | 4 | 3.4 | 1.18 | 8.2 |
| Colored Particle 4Bk | 4.6 | 3.7 | 1.24 | 4.1 | 3.1 | 1.32 | 13.6 |
| Colored Particle 5Bk | 4.7 | 4.3 | 1.09 | 4.1 | 3.6 | 1.14 | 6.3 |
| Colored Particle 6Bk | 3.9 | 3.7 | 1.05 | 3.3 | 2.8 | 1.18 | 6.8 |
| Colored Particle 7Bk | 3.8 | 3.4 | 1.12 | 3.2 | 2.7 | 1.18 | 11.3 |
| Colored Particle 8Bk | 3.9 | 3.8 | 1.03 | 3.3 | 2.8 | 1.18 | 6.3 |
| Colored Particle 9Bk | 5.6 | 5.3 | 1.06 | 5.1 | 4.5 | 1.13 | 8.5 |
| Colored Particle 10Bk | 5.5 | 4.8 | 1.15 | 4.9 | 4 | 1.23 | 12.5 |

TABLE 3-continued

| Colored Particle No. | 50% volume average particle diameter ($Dv_{50}$) (μm) | 50% number average particle diameter ($Dp_{50}$) (μm) | Dv50/Dp50 | Accumulated 75% volume average particle diameter ($Dv_{75}$) (μm) | Accumulated 75% number average particle diameter ($Dp_{75}$) (μm) | Dv75/Dp75 | Number-% of particles having not more than 0.7 × $Dp_{50}$ |
|---|---|---|---|---|---|---|---|
| Colored Particle 11Bk | 5.7 | 5.4 | 1.06 | 5.1 | 4.4 | 1.16 | 6.3 |
| Colored Particle 12Bk | 7.8 | 7.3 | 1.07 | 7.4 | 6.7 | 1.10 | 6.8 |

Preparation of Toner Particles

To each of Colored Particles Bk1 through Bk12, 1% by weight of hydrophobic silica having a number average primary particle diameter of 12 nm and a hydrophobicity of 68 and 0.5% by weight of hydrophobic titanium oxide having a number average primary particle diameter of 20 nm and a hydrophobicity of 63 were added and mixed by a Henschel mixer. Thus Toner Particles 1Bk through Bk12 were obtained.

The shape and physical properties of each of these toners were the same as those described in Table 3.

Preparation of Developer

To each of the toners, a ferrite carrier particle which was coated by silicone resin and has a volume average diameter of 60 μm was added and mixed. Thus Developers 1Bk through 12Bk were obtained each having a toner concentration of 6%.

Images are formed employing a SITIOS 7040 digital copying machine, manufactured by Konica Corp., employing a combination of each of the foregoing photoreceptors, developers and electrical field intensities as shown in Table 4. The identification number of the developer was the same as that of the toner used in the developer. Resultant images were compared and evaluated.

Evaluation

The photoreceptor was installed on the SITIOS 7040 digital copying machine, having a scorotron charging device, a semiconductor laser exposing device and a reversal developing means and image forming experiment was performed using that copying machine. The structure of the copying machine was basically the same as that shown in FIGS. 1 and 2. The digital copying machine was modified so that the objective unexposed area potential at the developing position was automatically set by employing a computer program for setting the objective unexposed area potential in the memory in the process controlling unit shown in FIG. 2. The machine was further modified so that the developing bias potential (Vbias) could also be automatically set at an objective value. The unexposed area potential was measured during the image formation by the foregoing potential sensor and the output value of the charging means was controlled via the controlling unit to attain the objective unexposed area potential when the objective unexposed area potential was not obtained.

Image Evaluation

The photoreceptors were each installed in the digital copying machine and the unexposed area potential (VH) was changed and the electrical field intensity applied to the photoreceptor and the toner were combined so that Combination Nos. 1 through 25 are as shown in Table 4. An original text image having a pixel ratio of 7% was copied to 50,000 A4 sheets under high humidity and temperature conditions of 80% and HR 30° C. A halftone image was copied at the start and on every 10,000th sheet to confirm the occurrence of image defects such as black spotting and white spotting.

Other evaluation conditions employing the foregoing copying machine 7040 was set as follows.

Charging Condition

Charging device: Scorotron charging device, initial objective charging potential: From −500 V to −600 V Exposing Condition Objective unexposed area potential: Exposure amount was controlled so that the objective unexposed area potential was −50 V.

Light beam for exposure: The spot area of the laser beam was $0.35\times10^{-9}$ $m^2$, employing a 680 nm semiconductor laser emitting light.

Transferring Condition

Corona Charging Method

Separation: Separating means of a separation claw was used.

Cleaning Condition

A cleaning blade at a hardness of 70°, a repulsion elasticity of 65%, a thickness of 2 mm and a free length of 9 mm was brought into contact with the photoreceptor in the counter direction with a weight so that the line pressure was 18 g/cm.

Evaluation Norm for Black Spotting Defects

Black spotting occurrence was evaluated based on their number per A4 sheet of visible black spots synchronously occurring with the cycle of the photoreceptor.

A: Three or fewer visible black spotting of not less than 0.4 mm per A4 sheet were observed on all copies: Good B: From 4 to 10 black spotting were observed on one or more A4 sheets: Acceptable for practical use C: 11 or more black spotting were observed on one or more A4 sheets: Unacceptable for practical use Evaluation Norm for White Spotting Defect White spotting occurrence was evaluated based the number per A4 sheet of the visible white spotting synchronously occurred with the cycle of the photoreceptor.

A: Five or fewer visible white spotting of not less than 0.4 mm per A4 sheet of copies were observed in all copies: Good B: From 6 to 20 black spotting were observed on one or more A4 sheets of copies: Acceptable for practical use C: 11 or more white spotting were observed on one or more A4 sheets of copies: Unacceptable for practical use Evaluation of Image Density, Gradation and Sharpness The copying condition for the evaluation was changed to a normal condition of 20° C. and 60% HR.

Image Density

The relative reflective optical density of a solid black image when the reflective density of the paper was set at 0 was measured using densitometer RD-918, manufactured by Macbeth Co., Ltd.

A: Density of the solid black image was not less than 1.3: Good

B: Density of the solid black image was from 1.0 to less than 1.3: Acceptable for practical use C: Density of the solid black image was from 0.7 to less than 1.0: Possible for practical use.

D: Density of the solid black image was less than 0.7: Unacceptable for practical use Gradation Reproducibility An original image of 60 steps between white through solid black was copied. The copied image was visually observed under sufficient day light and visible number of steps was determined. The gradation reproducibility was evaluated based on the significantly distinguishable number of image steps.

A: forty-one or more steps were observed: Good

B: From 21 to 40 steps were observed: Acceptable for practical use

C: From 11 to 20 steps were observed: Reconsideration is necessary for practical use but acceptable for an image in which gradation is not considered to be important.

D: Ten or fewer steps were observed: Unacceptable for practical use.

Sharpness

The sharpness of the image was evaluated based on the resolving power of the image. The evaluation results were classified according to the following norms.

A: The resolving power was not less than 16 lines/mm: Good

B: The resolving power was from 10 to 15 lines/mm: Acceptable for practical use.

C: The resolving power was not more than 9 lines/mm Unacceptable for a high resolution image

TABLE 4

| Combination No. | Photoreceptor No. | *1 | Total layer thickness (μm) | \|V\| (V) | \|E\| (V/μm) | Developer No. (= Toner number) | Black spot | White lacking of image | Image density | *2 | *3 | Remarks |
|---|---|---|---|---|---|---|---|---|---|---|---|---|
| 1 | 1 | 10.0 | 11.5 | 517.5 | 45 | 1Bk | A | A | D | D | C | *4 |
| 2 | 1 | 10.0 | 11.5 | 632.5 | 55 | 2Bk | A | A | B | A | B | *5 |
| 3 | 1 | 10.0 | 11.5 | 747.5 | 65 | 3Bk | A | A | A | A | A | *5 |
| 4 | 1 | 10.0 | 11.5 | 977.5 | 85 | 5Bk | A | A | A | A | A | *5 |
| 5 | 1 | 10.0 | 11.5 | 1092.5 | 95 | 6Bk | B | A | A | A | A | *5 |
| 6 | 1 | 10.0 | 11.5 | 1207.5 | 105 | 8Bk | C | C | A | A | A | *4 |
| 7 | 1 | 10.0 | 11.5 | 747.5 | 65 | 9Bk | A | A | A | A | A | *5 |
| 8 | 1 | 10.0 | 11.5 | 747.5 | 65 | 11Bk | A | A | A | A | A | *5 |
| 9 | 1 | 10.0 | 11.5 | 747.5 | 65 | 12Bk | A | A | A | A | B | *5 |
| 10 | 1 | 10.0 | 11.5 | 747.5 | 65 | 4Bk | A | C | B | B | D | *4 |
| 11 | 1 | 10.0 | 11.5 | 747.5 | 65 | 7Bk | A | C | B | B | A | *4 |
| 12 | 1 | 10.0 | 11.5 | 747.5 | 65 | 10Bk | A | C | B | B | D | *4 |
| 13 | 2 | 15.0 | 16.5 | 1072.5 | 65 | 1Bk | A | A | A | A | B | *5 |
| 14 | 3 | 5.0 | 6.5 | 422.5 | 65 | 1Bk | B | A | B | C | B | *5 |
| 15 | 4 | 16.0 | 17.5 | 1137.5 | 65 | 1Bk | A | B | A | A | D | *4 |
| 16 | 5 | 4.0 | 5.5 | 357.5 | 65 | 1Bk | B | A | D | D | D | *4 |
| 17 | 6 | 13.0 | 14.3 | 929.5 | 65 | 1Bk | A | A | A | A | A | *5 |
| 18 | 7 | 13.0 | 15.0 | 975 | 65 | 1Bk | A | A | A | A | A | *5 |
| 19 | 8 | 13.0 | 16.0 | 1040 | 65 | 1Bk | A | A | A | A | A | *5 |
| 20 | 9 | 13.0 | 14.5 | 942.5 | 65 | 1Bk | A | A | B | B | B | *5 |
| 21 | 10 | 13.0 | 14.5 | 942.5 | 65 | 1Bk | A | A | B | B | B | *5 |
| 22 | 11 | 13.0 | 14.5 | 942.5 | 65 | 1Bk | A | A | B | B | B | *5 |
| 23 | 12 | 13.0 | 14.5 | 942.5 | 65 | 1Bk | A | A | B | B | B | *5 |
| 24 | 13 | 13.0 | 14.5 | 942.5 | 65 | 1Bk | A | A | A | A | A | *5 |
| 25 | 14 | 13.0 | 14.5 | 942.5 | 65 | 1Bk | C | A | B | A | D | *4 |

*1; Thickness of charge transportation Layer (μm)
*2; Gradation reproducibility
*3; Sharpness
*4; Without the invention
*5; Within the invention In the above table, the thickness is the total thickness of the interlayer, charge generation layer and the charge transportation layer.

As is clear in Table 4, Combinations 2 through 5, 7 through 9, 13, 14 and 17 through 24 based on the invention attained superior results compared with combinations outside the invention in all the evaluated items of the black spotting occurrence, white spotting occurrence, image density and gradation reproducibility. The combinations according to the invention satisfy the conditions of the photoreceptor that the photoreceptor has a multilayer structure including the charge generation layer containing N-type charge generation material and the charge transportation layer at a thickness of from 5 to 15 μm; the condition of the toner that $Dv_{50}/Dp_{50}$ is from 1.0 to 1.15, $Dv_{75}/Dp_{75}$ is from 1. to 1.2 and the number of toner particles having a diameter of $0.7\times Dp_{50}$ is not more than 10%; and the condition of the electrical field intensity E during the reversal development satisfies the Expression of $50 \leqq |E| \leqq 100$. Combination No. 1 shows that the electrical field intensity E on the reversal development is 45, the image density, gradation reproducibility and sharpness were lowered even though the photoreceptor based on the invention is employed. Combination No. 6 shows that the electrical field intensity E during the reversal development is 105, occurrence of black spotting and white spotting are remarkable. Combination Nos. 10, 11 and 12, show that the condition of the toner is without the invention, many white spotting are formed and the image density and the sharpness are lowered. By Combination No. 25 in which Photoreceptor No. 14 outside the invention is employed, the black spotting are considerably formed and the sharpness is lowered.

An electrophotographic image can be obtained based on the invention, in which occurrence of the image defects of black spotting and white spotting, which are caused by opposite phenomena, is inhibited, and the image density and the gradation reproducibility are high. Moreover, an image forming apparatus showing a good image forming properties can be provided by applying the image forming method of the invention.

The invention claimed is:

1. A method of forming a toner image, comprising:

electrically charging a photoreceptor containing an organic photosensitive material;

imagewise exposing the photoreceptor so that a latent image is formed on the photoreceptor;

developing the latent image with toner so that a toner image is formed on the photoreceptor by a reversal development;

wherein the photoreceptor comprises a charge generation layer containing an N-type charge generation material, a charge transportation layer containing a charge transportation material and has a thickness of from 5 to 15 μm and an interlayer;

the toner contains colored particles comprising a resin and a colorant, and the colored particles have a ratio, $Dv_{50}/Dp_{50}$, of the 50% volume particle diameter $Dv_{50}$ to the 50% number particle diameter $Dp_{50}$ of from 1.0 to 1.15 and a ratio, $Dv_{75}/Dp_{75}$, of an accumulate of 75% volume average particle diameter from larger particle side to an accumulate of 75% number average particle diameter from larger particle side of from 1.0 to 1.20, and content of colored particles having a diameter of $0.7\times Dp_{50}$ is not more than 10 in number; and the reversal development is performed under condition satisfying the following expression:

$$50 \leqq |E| \leqq 100 \qquad \text{Expression 1}$$

E: Electrical field intensity applied to the organic photoreceptor that is a quotient of potential V in an unexposed area of the photoreceptor at a time of development divided by layer thickness of total thickness of the interlayer, charge generation layer and the charge transportation layer of the photoreceptor in V/μm.

2. The image forming method of claim 1, wherein the charge generation layer further contains a P-type pigment in an amount of not more than 10% by weight of the N-type charge generating material.

3. The image forming method of claim 2, wherein the P-type charge generating material is a titanyl phthalocyanine compound.

4. The image forming method of claim 1, wherein the N-type charge generation material is a perylene compound pigment.

5. The image forming method of claim 1, in which the perylene compound is a 3,4,9,10-tetracarboxylic acid imide derivative represented by the Formula 1, 2, 3a or 3b, or a mixture thereof, Formula 1

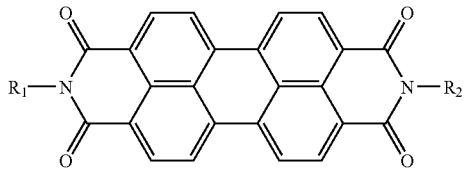

Formula 2

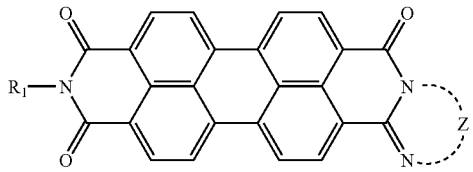

Formula 3a

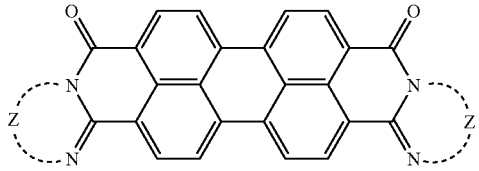

Formula 3b

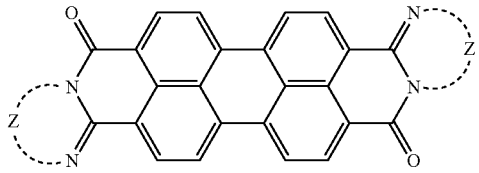

in the above formulas, $R_1$ and $R_2$ are each a hydrogen atom, or an alkyl group, a cycloalkyl group, an aryl group, an alkoxy group, an alkylamino group, a dialkylamino group, a benzyl group, a phenethyl group or a heterocyclic group, and the above organic groups may be substituted or unsubstituted; when the compound is a polymer, $R_1$ and $R_2$ each may be a 1,4-phenylene group; and Z is a group of atoms necessary to form a heterocyclic group.

6. The image forming method of claim 1, in which the perylene compound is represented by one of the following Formulas,

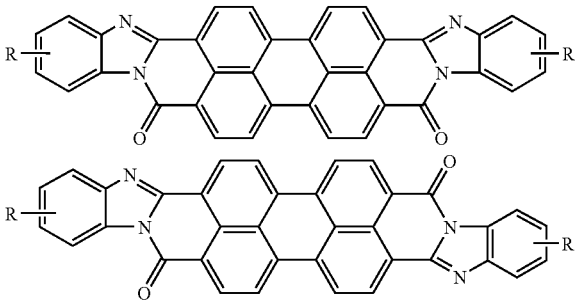

wherein R is a hydrogen atom, a halogen atom, an alkyl group having from 1–10 carbon atoms, an aryl group, an alkoxy group or a heterocyclic group.

7. The image forming method of claim 1, wherein the static latent image is formed by exposure to a light beam having an exposing spot area of not more than $2\times10^{-9}$ $m^2$.

8. The image forming method of claim 1, wherein thickness of the charge generation layer is from 0.3 to 2.0 μm.

* * * * *